US011179722B2

(12) United States Patent
Baroud et al.

(10) Patent No.: US 11,179,722 B2
(45) Date of Patent: Nov. 23, 2021

(54) MICROFLUIDIC METHOD FOR HANDLING MICRODROPS

(71) Applicants: ECOLE POLYTECHNIQUE, Palaiseau (FR); CENTRE NATIONAL DE LA RECHERCHE SCIENTIFIQUE, Paris (FR)

(72) Inventors: Charles Baroud, Paris (FR); Raphaël Tomasi, Paris (FR)

(73) Assignees: ECOLE POLYTECHNIQUE, Palaiseau (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 246 days.

(21) Appl. No.: 16/338,681

(22) PCT Filed: Sep. 29, 2017

(86) PCT No.: PCT/EP2017/074859
§ 371 (c)(1),
(2) Date: Apr. 1, 2019

(87) PCT Pub. No.: WO2018/060471
PCT Pub. Date: Apr. 5, 2018

(65) Prior Publication Data

US 2020/0038867 A1 Feb. 6, 2020

(30) Foreign Application Priority Data

Sep. 30, 2016 (FR) ..... 1659418

(51) Int. Cl.
*B01L 3/00* (2006.01)
*B01F 13/00* (2006.01)

(52) U.S. Cl.
CPC .... *B01L 3/502761* (2013.01); *B01F 13/0071* (2013.01); *B01F 13/0083* (2013.01);
(Continued)

(58) Field of Classification Search
CPC ..... B01L 3/502761; B01L 13/0071; B01L 13/0083; B01L 2200/0668; B01L 2200/0673
See application file for complete search history.

(56) References Cited

U.S. PATENT DOCUMENTS

2010/0190263 A1 7/2010 Srinivasan et al.
2013/0078163 A1* 3/2013 Chung ..... C12M 21/06 422/502
2015/0258543 A1 9/2015 Baroud et al.

FOREIGN PATENT DOCUMENTS

FR 2 950 544 A1 4/2011
WO 2016/059302 A1 4/2016

OTHER PUBLICATIONS

Fradet et al., "Combining rails and anchors with laser forcing for selective manipulation within 2D droplet arrays," Lab on a Chip, 2011, vol. 11, pp. 4228-4234.

(Continued)

*Primary Examiner* — Jennifer Wecker
*Assistant Examiner* — Kathryn Elizabeth Limbaugh
(74) *Attorney, Agent, or Firm* — Oliff PLC

(57) ABSTRACT

Method for handling at least one first microdrop and at least one second microdrop in a microfluidic system including a capillary trap that has a first trapping zone and a second trapping zone, the method including steps consisting of: (i) trapping the first microdrop in the first trapping zone, and (ii) trapping the second microdrop in the second trapping zone, the first and the second trapping zone being arranged such that the first and the second microdrops are in contact with each other, the first and the second trapping zones being adapted such that the trapping forces returned to one of the microdrops are different.

38 Claims, 13 Drawing Sheets

Figure 1B:
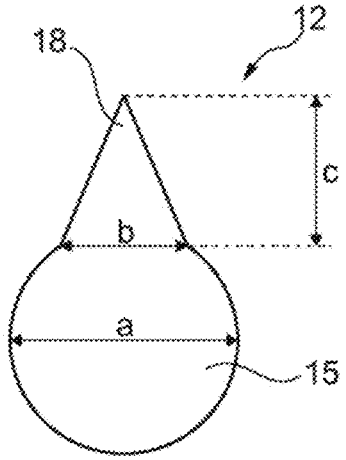

(52) U.S. Cl.
CPC ..... *B01L 2200/0668* (2013.01); *B01L 2200/0673* (2013.01); *B01L 2300/0893* (2013.01); *B01L 2400/0688* (2013.01)

(56) References Cited

OTHER PUBLICATIONS

Tullis et al., "Selective fusion of anchored droplets via changes in surfactant concentration," Lab on a Chip, 2014, vol. 14, pp. 3285-3289.
Fradet et al., "Parallel measurements of reaction kinetics using ultralow-volumes," Lab on a Chip, 2013, vol. 13, pp. 4326-4330.
Huebner et al., "Monitoring a Reaction at Submillisecond Resolution in Picoliter Volumes," Analytical Chemistry, Feb. 15, 2011, vol. 83, No. 4, pp. 1462-1468.
Dangla et al., "Trapping Microfluidic Drops in Wells of Surface Energy," Physical Review Letters, 2011, vol. 107, pp. 124501-1-124501-4.
Yamada et al., "Trapping and release of giant unilamellar vesicles in microfluidic wells," Soft Matter, 2014, vol. 10, pp. 5878-5885.
Nov. 7, 2017 International Search Report issued in International Patent Application No. PCT/EP2017/074859.

* cited by examiner

MICROFLUIDIC METHOD FOR HANDLING MICRODROPS

The present invention relates to a microfluidic method for handling several microdrops in at least one capillary trap of a microfluidic system. The invention also relates to a microfluidic device for carrying out said method.

PRIOR ART

Trapping of microdrops circulating in one or more microchannels in traps of approximately circular or oval shape, each trapping zone being dimensioned for trapping a predefined number of microdrops, is known from patent application FR 2 950 544.

Trapping and fusing of microdrops of roughly identical or of different sizes in a shallow trap of approximately circular shape of a microfluidic system, the latter being two-dimensional and having a plurality of traps, is also known from E. Fradet, C. McDougal, P. Abbyad, R. Dangla, D. McGloin, and C. N. Baroud, "*Combining rails and anchors with laser forcing for selective manipulation within 2D droplet arrays.*" *Lab Chip*, Vol. 11, No. 24, pp. 4228-34, December 2011, and J. Tullis, C. L. Park, and P. Abbyad, "*Selective Fusion of Anchored Droplets via Changes in Surfactant Concentration.*" *Lab Chip,* 2014. The microdrops trapped in one and the same trap are different.

Traps of this kind do not allow precise manipulation and/or control of the trapped microdrops, notably to adapt the traps to microdrops of different sizes, nor trapping of the microdrops in a spatially predefined manner.

E. Fradet, P. Abbyad, M. H. Vos, and C. N. Baroud, "*Parallel measurements of reaction kinetics using ultralow volumes.*" *Lab Chip*, Vol. 13, No. 22, pp. 4326-30, October 2013, describes a shallow trap having two identical zones of approximately circular shape that overlap partially to make the trap goggle-shaped. Each of the two zones makes it possible to trap one microdrop. The shape of the trap makes it possible to keep the two trapped microdrops in contact with one another so as to fuse them into a single microdrop. A trap of this kind is limited to handling two microdrops of roughly identical sizes and is not suitable for treating a large number of microdrops, which reduces the possible applications.

Moreover, a C-shaped trap for immobilizing and fusing two microdrops is known from A. M. Huebner, C. Abell, W. T. S. Huck, C. N. Baroud, and F. Hollfelder, "*Monitoring a Reaction at Submillisecond Resolution in Picoliter Volumes.*", *Anal Chem.* 2011 Feb. 15; 83(4): 1462-8. The trap is formed by projecting reliefs that block the microdrops in their flow. However, manipulation of the microdrops is limited notably owing to the shape of the traps, and retaining the microdrops in the traps requires the presence of an oriented stream of fluid in a precise direction.

Application WO 2016/059302 describes a method for handling microdrops in a microfluidic system comprising the step consisting of trapping the microdrops in a capillary trap and at least partially gelling the microdrops or their environment. The capillary trap is able to receive several microdrops in its depth, which is greater than the diameter of the trapped microdrops. However, depth-wise manipulation of the microdrops, notably of those that are trapped, is limited.

Application US 2015/0258543 proposes a method that allows different fluids to be brought into contact to obtain a reaction between them and allow analysis of the kinetics of this reaction. A microfluidic circuit is disclosed there, which is able to bring the microdrops, one at a time, into cavities serving as capillary traps. Two microdrops of different volumes can be brought into contact and received in an 8-shaped cavity. The dimensions of the two trapping zones, each trapping zone corresponding to a loop of the 8, correspond to the dimensions of the microdrops that are to be housed there. There is an energy barrier between these different trapping zones, associated with the shape of the cavity. For example, a microdrop supplied from the right will remain in the trapping zone on the right, on account of the 8-shape of the cavity.

Application US 2010/0190263 describes an actuator of droplets having hollowed regions separating two substrates. These substrates include electrodes for transporting the droplets to the hollowed regions. The purpose of the actuator is to form and retain a gas bubble in these hollowed regions.

The articles Dangla, R., Lee, S. & Baroud, C. N. Trapping microfluidic drops in wells of surface energy. Phys. Rev. Lett. 107, 124501 (1-4) (2011) and Yamada, A., Lee, S., Bassereau, P. & Baroud, C. N. Trapping and release of giant unilamellar vesicles in microfluidic wells. Soft Matter 10, 26-28 (2014) describe the physics associated with the trapping of microdrops, subjected to fluid flow, in a microchannel. The trapping force may result from the shape and size of the trap, the depth of the microchannel, the size of the microdrops, and the physical and physicochemical properties of the fluids present, such as viscosity, surface tension, etc.

There is therefore a need for a method for handling microdrops allowing the trapped microdrops to be controlled easily and to be trapped in a spatially predefined manner. There is also a need for a method allowing sequential manipulation of the microdrops.

SUMMARY

I. First Aspect—Method of Manipulation

For this purpose, according to a first of its aspects, the invention proposes a method for manipulating at least one first microdrop and at least one second microdrop in a microfluidic system comprising a capillary trap having a first trapping zone and a second trapping zone, said method comprising the steps consisting of:

trapping the first microdrop in the first trapping zone, and (ii) trapping the second microdrop in the second trapping zone, the first and the second trapping zone being arranged in such a way that the first microdrop and the second microdrop are in contact with one another, the first and the second trapping zone being configured in such a way that the trapping forces that would be exerted by the first and by the second trapping zone on a same first or second liquid microdrop would be different.

"Microfluidic system" denotes a system involving the transporting of at least one product, and which comprises, on at least one of its portions, a section, at least one dimension of which, measured in a straight line from one edge to an opposite edge, is less than a millimeter.

"Microdrop" means a drop having a volume less than or equal to 1 μl, better still less than or equal to 10 nl. The microdrop may be liquid, gaseous or solid.

"Capillary trap" means a spatial zone of the microfluidic system allowing temporary or permanent immobilization of one or more microdrops circulating in the microfluidic system. The capillary trap may be formed by one or more reliefs, notably hollowed reliefs, and/or by one or more local modifications of the surface in contact with the microdrops, notably one or more local modifications of the affinity of the surface with at least part of the contents of the microdrop.

"The trapping forces that would be exerted by the first and by the second trapping zone on a same first or second liquid microdrop would be different" means that if the first microdrop is trapped in the first trapping zone only, it will be retained in the latter by capillarity with a trapping force that is different from the trapping force that the second trap zone would exert on this same first microdrop on its own. Thus, it is easier to release the first microdrop from the trapping zone that exerts the smallest trapping force. The same reasoning may be applied to the second microdrop. The trapping force of a trapping zone depends notably on its shape, its surfaces in contact with the microdrop and/or the properties, notably the dimensions, of the microdrops to be trapped.

The fact that the capillary trap has two zones having different trapping forces exerted on one of the microdrops makes it possible to have both selectivity of the trapped microdrops and spatial selectivity, and notably to avoid the first microdrop occupying the second trapping zone, thus preventing the second microdrop from being trapped in this second trapping zone. This is particularly advantageous when a plurality of first and second microdrops is introduced into the microfluidic system.

The fact that the first and second microdrops are in contact allows them either to interact, or to coalesce.

Preferably, the first microdrop is trapped in the first trapping zone with a trapping force that is greater than what would be exerted by the second trapping zone on the first microdrop. Thus, the first microdrop is preferably trapped by the first trapping zone.

As a variant, the second microdrop is trapped in the second trapping zone with a trapping force that is smaller than what would be exerted by the first trapping zone on the second microdrop. In this case, the first and second microdrops are preferably introduced and trapped in the microfluidic system sequentially.

Preferably, the first microdrop is trapped by the first trapping zone in the microfluidic system before the second microdrop is trapped by the second trapping zone in the microfluidic system. Thus, when the second microdrop is introduced, it cannot occupy the first trapping zone as the latter is already occupied by the first microdrop.

An entraining force greater than the trapping force of the second trapping zone and less than or equal to the trapping force of the first trapping zone may be exerted in step (i) on the first microdrop. For example, the shape of the second trapping zone is selected in such a way that the trapping force of the second zone is less than the entraining force. In other words the microdrop is subjected to hydrodynamic forces owing to its entrainment that oppose its capture by the second trapping zone. The drag force exerted by the fluid conveying the microdrops may depend on the size and the instantaneous shape of the microdrops, the physical and physicochemical properties of the fluids (viscosity, surface tension, etc.) and the flow velocity. The first drop is then only trapped in the first trapping zones.

The entraining force may be exerted at least partially by an oriented stream of fluid flowing in the microfluidic system. In particular, the microdrops may be caused to move in the microfluidic system by an oriented stream of a fluid, in which the microdrops are, preferably, immiscible, the stream of fluid being such that, notably having a flow rate and an orientation such that, the first microdrop is only trapped by the first trapping zone. The force that the moving fluid exerts on the first drop prevents the latter being trapped in the second trapping zone;

gravity, the first microdrop being caused to move along a slope of the microfluidic system by its own weight. Thus, depending on the velocity at which the first microdrop arrives at the first trapping zone owing to the slope of the microfluidic system, the first microdrop is or is not retained by the first trapping zone;

the tendency of the first microdrop to minimize its surface tension. In particular, the microfluidic system may comprise reliefs that cause the first microdrop to move, notably a groove that becomes wider toward the capillary trap.

Preferably, the second microdrop is subjected to an entraining force as described in relation to the first microdrop, less than or equal to the trapping force of the second trapping zone. In the case when the entraining force is exerted on the second microdrop by an oriented stream of fluid, the force that the stream of fluid exerts on the first microdrop trapped in the first trapping zone is preferably insufficient to extract the first microdrop from the first trapping zone.

In the case when the entraining force on the second microdrop is exerted by an oriented stream of fluid, the latter may be oriented in such a way that the second microdrop can only be trapped in the second trapping zones having a particular orientation relative to the orientation of the stream, notably arranged upstream of the first trapping zone relative to the direction of the stream of fluid.

The microdrops being carried by a stream of fluid to a plurality of trapping zones, they are preferably led into the latter randomly and naturally occupy the place that is the most advantageous, from an energy standpoint, of the trapping zone. They lodge in the trapping zones by themselves. This random placement of the microdrops makes it possible to have a large number of microdrops trapped simultaneously, and increases the capacity of screening.

In embodiment examples, the method comprises the following steps:

trapping a first microdrop in a first trapping zone of the capillary trap, the trapping force F4 exerted by the first zone on the first microdrop being greater than the force Ft4 of hydrodynamic drag exerted by the flow (i.e. the oriented stream of fluid conveying the microdrops) on the first microdrop, in such a way that the latter remains trapped in the first zone, the drag force Ft4 being between F4 and F5, F5 denoting the trapping force exerted on the first microdrop by the second trapping zone of the capillary trap, then, trapping a second microdrop in the second zone of the capillary trap, the force of hydrodynamic drag Ft5 exerted on the second microdrop by the flow during loading of the second microdrop in the second zone being between F5 and F3, with F3 preferably less than F4, F3 being the trapping force exerted by the second zone of the capillary trap on the second microdrop.

Microdrops

Preferably, the trapping force that the first trapping zone exerts on the first microdrop is different from the trapping force that it would exert on the second microdrop and the trapping force that the second trapping zone exerts on the second microdrop is different from the trapping force that it would exert on the first microdrop. In fact, the trapping force also depends on the shape of the microdrop to be trapped in relation to the shape of the trapping zone. This facilitates sequential trapping of the first and second microdrops.

Preferably, the first trapping zone exerts a trapping force on the first microdrop that is greater than what it would exert on the second microdrop. This makes it possible to prevent the second microdrop dislodging and taking the place of the first microdrop.

The first and the second microdrop may be different, in particular of different sizes, notably the first microdrop being of larger size and/or of larger volume than the second microdrop, and/or with different contents. This guarantees that the first trapping zone exerts a trapping force on the first microdrop that is greater than what it would exert on the second microdrop; consequently, there will only be a single microdrop in the first trapping zone.

The first trapping zone may trap one or more first microdrops.

The second trapping zone may trap one or more second microdrops.

As a variant, the first and second microdrops are different in at least one of their properties, notably their viscosity and/or their interfacial tension and/or their affinity with a particular coating of at least one of the trap zones.

Preferably, the first trapping zone only traps a first microdrop and/or the second trapping zone only traps a second microdrop. In particular:

- the largest dimension of the first microdrop when it is trapped, viewed from above, may be greater than or equal to the largest dimension of the first trapping zone viewed from above, and/or
- the largest dimension of the second microdrop when it is trapped, viewed from above, may be greater than or equal to the largest dimension of the second trapping zone viewed from above, and/or
- the first microdrop, when it is trapped, fills at least 70%, better still 80%, even better 90%, of the volume of the first trapping zone, and/or
- the second microdrop, when it is trapped, fills at least 70%, better still 80%, even better 90%, of the volume of the second trapping zone, and/or
- the volume of the first microdrop, when it is trapped, is greater than or equal to that of the first trapping zone, so that the first microdrop extends partially outside of the first trapping zone, and/or
- the volume of the second microdrop, when it is trapped, is greater than or equal to that of the second trapping zone, so that the second microdrop extends partially outside of the second trapping zone.

One of the first microdrop(s) or second microdrop(s) may be a microbubble of air.

Plurality of Second and/or First Trapping Zones

The capillary trap may comprise a plurality of second trapping zones, step (ii) consisting of trapping one second microdrop per second trapping zone, the first and the second trapping zones being arranged in such a way that each second microdrop is in contact with at least one of the first or of the second microdrops.

The capillary trap may comprise a plurality of first trapping zones, step (i) consisting of trapping one first microdrop per first trapping zone, the first and the second trapping zone or zones being arranged in such a way that each first microdrop is in contact with at least one of the second microdrop(s) or of the first microdrops.

Preferably, each second microdrop is joined to the or each first microdrop.

"Joined to" means that each second microdrop is either directly in contact with said first microdrop, or in contact with another second microdrop or a string of second and/or first microdrops, itself in contact with said first microdrop.

"String of microdrops" means a plurality of microdrops forming a straight line or curved line in contact with one another.

The second microdrops may all be in contact with at least one first microdrop trapped in said capillary trap.

At least two second trapping zones may be configured so that the trapping forces that they would exert on one of said second liquid microdrops would be different. The second microdrops trapped by at least two second trapping zones may be different with respect to at least one of their properties, notably their largest dimension.

As a variant, all the second trapping zones of the capillary trap are identical.

Plurality of Capillary Traps

The microfluidic system may comprise a plurality of capillary traps, each comprising a first trapping zone and a second trapping zone, step (i) consisting of trapping a first microdrop in the first trapping zone of each capillary trap, step (ii) consisting of trapping a second microdrop in the second trapping zone of each capillary trap, the first and the second trapping zone of each capillary trap of the plurality of capillary traps being arranged in such a way that the first and the second microdrop trapped in said capillary trap are in contact with one another in the latter.

Each capillary trap may comprise one or more of the features described above.

All the traps of the microfluidic system may each comprise a first trapping zone and a second trapping zone arranged in such a way that the first and the second microdrop trapped in said capillary trap are in contact with one another in the latter.

As a variant, only some of the capillary traps of the microfluidic system each comprise a first trapping zone and a second trapping zone arranged in such a way that the first and the second microdrop trapped in said capillary trap are in contact with one another in the latter.

The method may comprise the step consisting of trapping a microbubble of gas, notably of air, in one of the first or second trapping zones. This makes it possible to render the trapping zone in question inactive. In fact, owing to the presence of the gas microbubble, the first or second microdrops cannot be trapped in the trapping zone in question.

Oriented Stream of Fluid

Step (ii) may comprise the substeps (ii') consisting of trapping, under the effect of a first oriented stream of fluid, a second microdrop in one or some of the second trapping zones and (ii") consisting of trapping, under the effect of a second oriented stream of fluid, a second microdrop in another or some others of the second trapping zones, the first and the second stream of fluid being of different orientation.

The second microdrops of steps (ii') and (ii") may differ notably by at least one of their properties and/or their contents. The second trapping zones of steps (ii') and (ii") may be identical.

Thus, it is possible, by selecting the orientation of the stream of fluid, to trap microdrops selectively in one of the two trapping zones, which allows predefined spatial positioning of the microdrops in contact with one another. It is then possible to bring a first microdrop into contact with different second microdrops in a controlled manner, notably in the context of combinatorial chemistry. It is also possible, in the context of microdrops comprising gels, to control the spatial disposition of gel microdrops in the capillary trap so as to obtain a microdrop of controlled shape and composition after fusion.

Coalescence

The method may comprise the step (iii) consisting of fusing, with the first microdrop, the or each of the second microdrops trapped in the or each of the second trapping zones. Such coalescence notably allows the contents of the two microdrops to be mixed.

Said coalescence may be selective, i.e. we may select the second microdrop or microdrops in contact with the first microdrop that we wish to fuse with the latter, notably by using an infrared laser, as is described for example in the document E. Fradet, P. Abbyad, M. H. Vos, and C. N. Baroud, "*Parallel measurements of reaction kinetics using ultralow volumes.*" *Lab Chip*, Vol. 13, No. 22, pp. 4326-30, October 2013, the contents of which are incorporated by reference, addressable electrodes arranged at the level of the capillary trap, or mechanical waves.

As a variant, the coalescence of the microdrops is non-selective, i.e. all of the second microdrops of the capillary trap fuse simultaneously with the first microdrop, notably by adding a product that promotes this coalescence to the environment of the capillary trap or application of an external physical stimulus such as mechanical waves, pressure waves, a temperature change or an electric field.

Release of the Second Microdrops

As a variant, step (iii) consists of evacuating the or at least one second microdrop trapped in the second trapping zone outside of the capillary trap. Step (iii') may consist of applying an oriented stream of fluid, configured for exerting, on one or more second microdrops, an entraining force greater than the trapping force of the second trapping zone, the stream of fluid being configured for exerting, on the first microdrop or microdrops, an entraining force less than or equal to the trapping force of the first trapping zone, so that the first microdrop or microdrops remain trapped in the first trapping zone.

In this step, it is possible to evacuate one or more of the second microdrops from the second trapping zones, the capillary trap being configured so that, owing to its orientation, the stream of fluid exerts different forces of entrainment on the second trapping zones, the method preferably comprising step (iv) consisting of changing the orientation of the stream of fluid so as to evacuate at least one or more of the second microdrops from at least one other trapping zone. This allows selective release of the second microdrops. Thus, a first microdrop and one or more second microdrops may be brought into contact with one another for a defined time sufficient so that, in particular owing to the interactions between the first microdrop and the second microdrop or microdrops, the second microdrop or microdrops undergo a change, for example a change of contents, and are then released to be analyzed. This may also allow the second microdrops to be changed for other second microdrops in the case of an error in the protocol prior to coalescence of the microdrops.

Third Microdrop

The method may comprise, after step (iii) or (iii'), the step (v) consisting of trapping a third microdrop in the second trapping zone or zones that no longer have a second microdrop, so that the first and the third microdrop are in contact with one another. The third microdrop may be identical to or different from the second microdrop. The third microdrop may be fused with the microdrop trapped in the first trapping zone or released, as described above for the second microdrop. Step (vi) may be repeated several times. This makes it possible for example to:

- dilute the contents of the first or second microdrops sequentially,
- supply an additional reagent to the contents of the first microdrop or microdrops trapped in the first trapping zone,
- renew, several times, the culture medium of one or more first microdrops containing cells trapped in the first trapping zone,
- supply, several times, to one or more first microdrops containing a pathogen or sick cells, at given time intervals, a medicinal product to evaluate its posology for a treatment, or
- supply, several times, cells in order to form a microtissue having several cellular layers.

Release of the Capillary Trap

The method may comprise the step (vi) consisting of evacuating all of the microdrops present in the capillary trap outside the capillary trap, notably using a stream of fluid exerting an entraining force greater than the trapping forces that are exerted on the microdrops. Such a step may allow the microdrops to be released in order to analyze them.

The method may comprise the step consisting of taking a measurement of the state of the microfluidic system. This measurement may be performed before and/or after fusion and/or release of the drops.

Preferably, the final microdrop or microdrops obtained may comprise a means of identifying their contents, notably labeling by the presence of a number of beads or particles, by the presence of varied colors or shapes and/or by a colorimetric or fluorescence signal proportional to an initial concentration of a compound contained in one of the first microdrop and second microdrop.

The method described above may be carried out using the microfluidic system that is described hereunder.

Additional Steps

The method may comprise an additional step of

- incubation, and/or
- observation or measurement, notably by imaging, by colorimetric, fluorescence, spectroscopic (UV, Raman) or temperature measurement.

These steps may take place before and/or after coalescence of the microdrops.

The step of observation or measurement may make it possible to determine the contents of each microdrop before and/or after fusion and for example determine the changes that occurred following fusion.

The observation step is, for example, particularly useful in the context of using a library of different microdrops for mapping the various microdrops before fusion.

II. Microfluidic Device

The invention also relates to a microfluidic device for trapping microdrops, notably for implementing the method as claimed in any one of the preceding claims, comprising a capillary trap having a first trapping zone and a second trapping zone arranged in such a way that a first microdrop trapped in the first trapping zone and a second microdrop trapped in the second trapping zone are in contact with one another in the capillary trap, the first and the second trapping zone being configured in such a way that the trapping forces that would be exerted by the first and by the second trapping zone on a same first or second liquid microdrop would be different.

The fact that the capillary trap has two zones having different trapping forces exerted on one of the microdrops makes it possible to have both selectivity of the trapped microdrops and trapping of the microdrops in a spatially predefined manner, notably to avoid the first microdrop occupying the second trapping zone, thus preventing the second microdrop being trapped in the latter. This is particularly true when a plurality of first and second microdrops are introduced into the microfluidic system.

The fact that the first and second microdrops are in contact allows them either to interact, or to be able to fuse easily.

Trapping Zones

The first and the second trapping zones are preferably cavities. The use of trapping zones in the form of a cavity facilitates manipulation of the microdrops and notably trapping them and/or releasing them.

The first and the second trapping zone may be separate.

As a variant, the first and the second trapping zone are joined together.

Preferably, the capillary trap lacks symmetry of revolution, when viewed from above. This anisotropy makes it possible to have trapping of the microdrops in a spatially predefined manner.

Preferably, the first trapping zone and the second trapping zone are arranged side by side, when viewed from above.

The first and the second trapping zones are preferably different by at least one of their dimensions. In particular, the first and the second trapping zones are of different heights, the first trapping zone notably being higher than the second trapping zone or the first and the second trapping zones are of different shapes, when viewed from above, the first trapping zone notably having a larger section than the second trapping zone. The difference in trapping force is then connected at least partially with the size, notably the height or the section when viewed from above, of the trapping zones.

"Height of the trapping zone" means, in cross section, the average height of the trapping zone of the microfluidic system.

The second trapping zone may become wider in at least one direction on approaching the first trapping zone. This makes it possible to guide the second microdrop in the direction of the first microdrop to keep it in contact with the latter. In fact, in order to minimize its surface energy, the second microdrop tends to move along the second trapping zone toward the zone with larger dimension.

The second trapping zone may become wider on approaching the first trapping zone, when viewed from above. Preferably, the divergence angle $\alpha$ is such that the second microdrop is always in contact with the two opposite walls defining it. The second trapping zone may become wider with a divergence angle $\alpha$ that is not zero, notably between 10° and 120°. The second trapping zone may have an approximately triangular or truncated triangular shape.

The second trapping zone may have a height that increases in the direction of the first trapping zone.

Preferably, the height of the second trapping zone is less than or equal to the largest dimension of the first trapping zone, better still less than or equal to half the largest dimension of the first trapping zone. The fact that the height of the second trapping zone is limited makes it possible to avoid the flow lines of the fluid being perturbed by the second trapping zone to the point of preventing the second microdrop being trapped.

The height of the first trapping zone may be such that the volume of the latter is greater than or equal to the volume of the first microdrop. This makes it possible to have a first trapping zone that has a high trapping force, in which the first microdrop is slightly deformed, in particular having a concave lower interface, which may facilitate, after sedimentation, bringing encapsulated elements into contact to form a cluster, for example of cells to form a spheroid.

Plurality of Second and/or First Trapping Zones

The capillary trap may comprise a plurality of second trapping zones arranged in such a way that each second trapped microdrop is in contact with at least one of the first or second microdrops trapped in the capillary trap.

The capillary trap may comprise a plurality of first trapping zones arranged in such a way that each first trapped microdrop is in contact with at least one of the second microdrop or microdrops or of the first microdrops trapped in the capillary trap.

Preferably, the first and second trapping zone(s) are arranged so that each second microdrop is joined to the or each first microdrop.

The first and second trapping zone(s) may be arranged in such a way that the second microdrops are all in contact with at least one first microdrop trapped in said capillary trap.

At least two second or first trapping zones may be configured so that the trapping forces that they would exert on one of said second liquid microdrops would be different. The second microdrops trapped by at least two second trapping zones may be different with respect to at least one of their properties, notably their largest dimension.

As a variant, all the second trapping zones of the capillary trap are identical.

Plurality of Capillary Traps

Preferably, the device comprises a plurality of capillary traps each comprising a first trapping zone and a second trapping zone, preferably arranged in such a way that the second microdrop trapped in the second trapping zone of the capillary trap is in contact with the first microdrop trapped in the first trapping zone of said capillary trap.

Each capillary trap may comprise one or more of the features described above.

All the capillary traps of the device may each comprise at least one first trapping zone and at least one second trapping zone.

As a variant, some of the capillary traps each comprise at least one first trapping zone and at least one second trapping zone and some of the capillary traps only comprise a single trapping zone, only allowing a single first microdrop to be trapped. These capillary traps comprising a single trapping zone may serve as a control during an experiment.

The device may comprise at least 10 capillary traps per square centimeter, better still at least 100 capillary traps per square centimeter. A large number of capillary traps notably makes it possible to do combinatorial chemistry, carry out screening of medicinal products, study protein crystallization, carry out titration of a chemical species, or personalize a treatment, notably in the case of cancer treatment.

At least two capillary traps may be different. For example, the device comprises a first capillary trap comprising n second trapping zones and a second capillary trap comprising p second trapping zones, n being different from p. Capillary traps of this kind can provide, after coalescence of the second microdrops with the first microdrops, microdrops trapped in the first trapping zones having different concentrations and/or sizes of drops. The microfluidic system may have more than two capillary traps having different quantities of second trapping zones in order to produce several concentrations and/or sizes of microdrops, notably a gradient of concentrations and/or sizes of microdrops. The microdrops obtained, with different concentrations, can form a panel of microdrops useful in the field of combinatorial chemistry, for studying protein crystallization, carrying out titration of a chemical species or personalizing a treatment, notably in the case of cancer.

As a variant, the capillary traps are all identical.

The device may comprise a channel having a trapping chamber, the capillary trap or traps being in the trapping chamber.

III. Second Aspect—Method of Manipulation

According to a second aspect, the invention also relates to a method of manipulating a plurality of first microdrops and a plurality of second microdrops in a microfluidic system comprising a channel having a trapping chamber comprising a plurality of capillary traps distributed in at least two different directions, each capillary trap having a first trapping zone and a second trapping zone, said method comprising the steps consisting of:

(i) trapping a first microdrop in the first trapping zone of each capillary trap, and (ii) trapping a second microdrop in the second trapping zone of each capillary trap, the first and the second trapping zone of one and the same capillary trap being arranged in such a way that the first microdrop and the second microdrop are in contact with one another in the capillary trap, the capillary traps each having an anisotropic form.

The fact that there is a plurality of capillary traps makes it possible to form a plurality of pairs of first and second microdrops simultaneously. The different pairs of first and second microdrops may then be different or identical.

The fact that the capillary traps are anisotropic makes it possible to have predefined spatial positioning of the microdrops once they are trapped by the trapping zones.

Preferably, the first and the second trapping zones of each capillary trap are configured so that the trapping forces that would be exerted by the first and by the second trapping zone on a same first or second liquid microdrop would be different.

One or more of the features described above in connection with the method or device according to the preceding aspects of the invention may apply to the method according to this aspect of the invention.

The method may be carried out using a microfluidic system for trapping microdrops comprising a channel having a trapping chamber comprising a plurality of capillary traps distributed in at least two different directions, each capillary trap having a first trapping zone and a second trapping zone arranged in such a way that a first microdrop trapped in the first trapping zone and a second microdrop trapped in the second trapping zone of the same capillary trap are in contact with one another, the capillary traps each having an anisotropic form.

Preferably, the first and the second trapping zones of each capillary trap are configured so that the trapping forces that would be exerted by the first and by the second trapping zone on a same first or second liquid microdrop would be different.

One or more of the features described above in connection with the microfluidic system according to the preceding aspects of the invention may be applied to the microfluidic system according to this aspect of the invention.

IV. Third Aspect—Method of Manipulation

According to a third aspect, the invention also relates to a method for manipulating at least one first microdrop and at least one second microdrop in a microfluidic system comprising a capillary trap having a first trapping zone and a second trapping zone, the second trapping zone becoming wider in at least one dimension on approaching the first trapping zone, said method comprising the steps consisting of:

(i) trapping the first microdrop in the first trapping zone, and (ii) trapping the second microdrop in the second trapping zone, the first and second trapping zones of one and the same capillary trap being arranged in such a way that the first microdrop and the second microdrop are in contact with one another in the capillary trap.

The fact that the second trapping zone becomes wider in at least one dimension on approaching the first trapping zone makes it possible to guide the second microdrop toward the first microdrop during trapping thereof and keep the latter in contact with the first microdrop. In fact, in order to minimize its surface energy, the second microdrop tends to move along the second trapping zone toward the zone with larger dimension.

The second trapping zone preferably becomes wider, viewed from above, on approaching the first trapping zone.

The second trapping zone may become wider with a divergence angle $\alpha$ between 10° and 120°.

The second trapping zone may have a height that increases in the direction of the first trapping zone.

Preferably, the first and the second trapping zone are configured so that the trapping forces that would be exerted by the first and by the second trapping zone on a same first or second liquid microdrop would be different.

One or more of the features described above in connection with the methods or devices according to the preceding aspects of the invention may apply to the method according to this aspect of the invention.

The method may be carried out using a microfluidic system for trapping microdrops comprising a capillary trap having a first trapping zone and a second trapping zone arranged in such a way that a first microdrop trapped in the first trapping zone and a second microdrop trapped in the second trapping zone of the same capillary trap are in contact with one another, the second trapping zone becoming wider in at least one dimension on approaching the first trapping zone.

Preferably, the first and the second trapping zone are configured so that the trapping forces that would be exerted by the first and by the second trapping zone on a same first or second liquid microdrop would be different.

One or more of the features described above in connection with the microfluidic systems according to the preceding aspects of the invention may be applied to the microfluidic system according to this aspect of the invention.

V. Fourth Aspect—Method of Cellular Assembly

According to a fourth aspect, the invention also relates to a method of cellular assembly of at least one first microdrop containing first cells and of at least one second microdrop containing second cells, in a microfluidic system comprising a capillary trap having a first trapping zone and a second trapping zone, said method comprising the steps consisting of:

(i) trapping the first microdrop in the first trapping zone, and (ii) trapping the second microdrop in the second trapping zone, the first and the second trapping zone of one and the same capillary trap being arranged in such a way that the first microdrop and the second microdrop are in contact with one another in the capillary trap, (iii) fusing the first microdrop with the second microdrop to form a microtissue by adherence of the first and second cells together.

Such a method may allow microtissues to be created in vitro with a controlled architecture for very faithfully mimicking the conditions encountered in vivo. In fact, in the body, the different cell types are often arranged in tissues according to a specific architecture that it is important to reproduce optimally to recreate a function at the level of an organ. This three-dimensional culture with controlled architecture may be used with a view to transplantation in a patient. It is, for example, possible to culture glucagon-producing alpha cells, and insulin-producing beta cells, to create islets of Langerhans that may be transplanted into a patient's pancreas for treating diabetes. Similarly, hepatocytes and stellate cells may be combined in the context of a liver transplant.

Step (ii) may be carried out after aggregation of the first cells, in particular after formation of a first spheroid formed by adherence of the first cells to one another. If the first microdrop containing the first spheroid is liquid, the second cells will, after fusion of the two microdrops, be mixed with the contents of the first microdrop and then sediment to obtain the first spheroid directly. If step (iii) takes place before the second cells have had time to form a second spheroid, they will be deposited after sedimentation on the surface of the first spheroid initially in the first microdrop.

Step (iii) may be carried out after aggregation of the second cells, in particular after formation of a second spheroid formed by adherence of the second cells together. Thus, the first and the second spheroid may be fused together.

The architecture of the microtissues obtained therefore depends on the experimental conditions.

The method may comprise an additional step of gelation of the first microdrops, said step taking place before step (iii) and preferably before step (ii). This makes it possible to compartmentalize the cells. In fact, if the first microdrops, which contain the spheroids, are gelled before arrival of the second microdrops, the second cells contained will no longer be able, after coalescence, to come directly into contact with the first spheroid, for example mammalian cells cannot pass through a matrix of agarose at 0.9 wt %. The first and the second cells can then only communicate with one another by the paracrine route.

The first and second cells may be of different cell types.

Preferably, the first and the second trapping zones are configured so that the trapping forces that would be exerted by the first and by the second trapping zone on a same first or second liquid microdrop would be different.

One or more of the features described above in connection with the methods or devices according to the preceding aspects of the invention may apply to the method according to this aspect of the invention.

The method may be carried out using one of the microfluidic systems according to the preceding aspects.

VI. Fifth Aspect—Method of Cell Culture

According to a fifth aspect, the invention also relates to a method of cell culture in a microfluidic system of at least one first microdrop containing a cell culture and at least one second microdrop containing a culture medium, the microfluidic system comprising a capillary trap having a first trapping zone and a second trapping zone, said method of culture comprising the steps consisting of:

(i) trapping the first microdrop in the first trapping zone, and (ii) trapping the second microdrop in the second trapping zone, the first and the second trapping zone of one and the same capillary trap being arranged in such a way that the first microdrop and the second microdrop are in contact with one another in the capillary trap, (iii) fusing the first microdrop with the second microdrop to renew the culture medium of the cell culture performed in the first microdrop.

Sequential injection of the culture medium may make it possible to renew the latter several times in order for example to allow culture of the cell or cells in the first microdrop.

The second microdrop may comprise an active ingredient to be tested in order to model the intermittent nature of administration of a medicinal product. For example, a drop containing a spheroid of mammalian cells may be fused every 6 hours with a microdrop containing an active ingredient to be tested, notably a medicinal product.

The method may comprise, after step (iii), step (iv) consisting of repeating steps (ii) and (iii) to renew yet again the culture medium of the cell culture performed in the first microdrop.

Preferably, the first and the second trapping zone are configured so that the trapping forces that would be exerted by the first and by the second trapping zone on a same first or second liquid microdrop would be different.

One or more of the features described above in connection with the methods or devices according to the preceding aspects of the invention may apply to the method according to this aspect of the invention.

The method may be carried out using one of the microfluidic systems according to the preceding aspects.

VII. Sixth Aspect—Method of Forming Gelled Microdrops

According to a sixth aspect, the invention also relates to a method of forming multilayer gelled microdrops of at least one first microdrop of a first gellable medium and of at least one second microdrop of a second gellable medium in liquid form in a microfluidic system comprising a capillary trap having a first trapping zone and a second trapping zone, said method comprising the steps consisting of:

(i) trapping the first microdrop in the first trapping zone, (ii) gelling the first gellable medium in the first trapping zone, (iii) trapping the second microdrop in the second trapping zone, the first and the second trapping zone of one and the same capillary trap being arranged in such a way that the first microdrop and the second microdrop are in contact with one another in the capillary trap, (iv) fusing the first microdrop with the second microdrop.

This makes it possible to form complex gel microdrops having variable shapes and/or mechanical properties, for example porosity and/or rigidity, and/or chemical properties, for example composition and/or concentration.

The method may comprise a step (v) taking place before or after step (iv) and consisting of gelling the second gellable medium.

When step (v) takes place after step (iv), gelation makes it possible to form an outer layer of the second gel on the first microdrop. This makes it possible to form complex gel microdrops having radially variable mechanical and/or chemical properties. These microdrops of gels could be used with stem cells whose differentiation is notably controlled by the rigidity of the gel. Microdrops of gels with layers of different hydrogels containing different cell types may also make it possible to model the different layers of the skin in the context of cosmetic tests. A microdrop having a collagen core and an agarose outer layer with pores that are small enough may be used for creating a spheroid of neurons, only the axonal projections of which can be extracted via the pores of the outer layer.

When step (v) takes place before step (iv), the second gellable medium is gelled in the second trapping zone. This makes it possible to form complex gel microdrops having radially variable shapes, and/or mechanical and/or chemical properties. The microdrops formed then keep the shape and arrangement of the first and second microdrops before fusion. The disposition, shape and number of the different trapping zones therefore allow direct control of the shape of the final microdrop. Microdrops of this kind may make it possible to model complex shapes. The controlled shapes of the microdrops may also serve as an identifier of the latter.

Step (v) may take place before or after step (iii) of trapping in the second trapping zone.

Step (ii) may take place before or after step (i) of trapping in the first trapping zone.

The method preferably comprises a step (vi) consisting of repeating operations (iii) to (v).

The first and second gellable media may be different.

Preferably, the first and the second trapping zone are configured so that the trapping forces that would be exerted by the first and by the second trapping zone on a same first or second liquid microdrop would be different.

One or more of the features described above in connection with the methods or devices according to the preceding aspects of the invention may apply to the method according to this aspect of the invention.

The method may be carried out using one of the microfluidic systems according to the preceding aspects.

VIII. Seventh Aspect—Method of Encapsulating the Cells

According to a seventh aspect, the invention also relates to a method for encapsulating at least one first microdrop and at least one second microdrop in a microfluidic system comprising a capillary trap having a first trapping zone and a second trapping zone, one of the first microdrop and second microdrop comprising a gellable medium and the other comprising a plurality of cells, said method comprising the steps consisting of:

(i) trapping the first microdrop in the first trapping zone, (ii) trapping the second microdrop in the second trapping zone, the first and the second trapping zone of one and the same capillary trap being arranged in such a way that the first microdrop and the second microdrop are in contact with one another in the capillary trap, (iii) fusing the first microdrop with the second microdrop, (iv) gelling the gellable medium to encapsulate the plurality of cells in the gel.

This method notably makes it possible to obtain spheroids encapsulated in biological hydrogels. In fact, in order to be able to form spheroids in microdrops in a controlled manner, it must be possible to keep the contents of the drop liquid during the time of formation of the spheroids. Agarose is very suitable for this protocol as it is a heat-sensitive hydrogel. It remains liquid at 37° C. and then solidifies after 30 min at 4° C. and remains solidified after returning to 37° C. However, mammalian cells cannot adhere to agarose and they cannot digest it either. This matrix is therefore very different from the extracellular matrix encountered in the body. The use of hydrogels such as for example type I collagen, fibronectin, Matrigel® or gelatin might be preferable for better simulation of natural conditions. However, it is more difficult to control their gelation. For example, type I collagen cannot be kept liquid for a long time with favorable conditions for cell culture (low temperature or acid pH). If cells are encapsulated in a drop of collagen that is gelled rapidly after trapping the cells, rather than adhere to one another and form a spheroid, the cells will adhere to the collagen and migrate individually along its fibers.

This problem may be solved by the aforementioned method. In fact, the cells may be encapsulated in the first liquid microdrops within the first trapping zone so as to form a spheroid. Second microdrops may then be supplied, which will lodge in the second trapping zone and which contain one of the biological hydrogels mentioned above, notably in high concentration. Once these second microdrops are trapped, the first and second microdrops in contact are fused immediately and the biological hydrogel, still liquid, will mix with the first microdrop that contains the spheroid. Gelation may then take place and will therefore encapsulate the spheroid in an extracellular matrix representative of the biological conditions encountered in vivo.

Step (ii) may be carried out after aggregation of the first cells, in particular after formation of a spheroid formed by adherence of the first cells to one another.

Preferably, the first and the second trapping zone are configured so that the trapping forces that would be exerted by the first and by the second trapping zone on a same first or second liquid microdrop would be different.

One or more of the features described above in connection with the methods or devices according to the preceding aspects of the invention may apply to the method according to this aspect of the invention.

The method may be carried out using one of the microfluidic systems according to the preceding aspects.

IX. Eighth Aspect—Method of Dilution

According to an eighth aspect, the invention also relates to a method of diluting a compound of interest in a microfluidic system comprising a first capillary trap comprising a first trapping zone and n second trapping zones and a second capillary trap comprising a first trapping zone and p second trapping zones, n being different from p, said method comprising the steps consisting of:

(i) trapping a first microdrop comprising the compound of interest in each first trapping zone, the first microdrops having identical concentration of the compound of interest, and then (ii) trapping a second microdrop of a diluting compound in each second trapping zone, the first and the second trapping zones of one and the same capillary trap being arranged in such a way that each second microdrop is in contact with at least one of the first or second microdrops of the same first or second capillary trap and so that, in each of the first and second capillary trap, at least one of the second microdrops is in contact with the first microdrop of the same first or second capillary trap, and then (iii) fusing the first and second microdrops in contact with one another so as to obtain microdrops with different concentrations in the first and the second capillary trap.

If the first drops contain a compound of interest at constant concentration, a spatial gradient of concentration may be obtained after coalescence with the second microdrops, which may for example contain a diluent. With such a method it may be possible to obtain a panel of microdrops with different controlled concentrations, starting from microdrops with the same concentration. This may for example be advantageous for forming a panel of microdrops of different concentrations for application in combinatorial chemistry, in the investigation of protein crystallization, in a subsequent method for titration of a chemical species, or in the personalization of a treatment, notably in the case of cancer.

Preferably, the first and the second trapping zones of each capillary trap are configured so that the trapping forces that would be exerted by the first and by the second trapping zone on a same first or second liquid microdrop would be different.

One or more of the features described above in connection with the methods or devices according to the preceding aspects of the invention may apply to the method according to this aspect of the invention.

The method may be used by the microfluidic system for dilution of microdrops comprising a first capillary trap comprising a first trapping zone and n second trapping zones and a second capillary trap comprising a first trapping zone and p second trapping zones, n being different from p, the first and second capillary trap being configured so that the second microdrops trapped in each of the second trapping zones are in contact with the first microdrop trapped in the corresponding first trapping zone in the first and the second capillary trap.

Preferably, the first and the second trapping zones of each capillary trap are configured so that the trapping forces that would be exerted by the first and by the second trapping zone on a same first or second liquid microdrop would be different.

One or more of the features described above in connection with the microfluidic systems according to the preceding aspects of the invention may be applied to the microfluidic system according to this aspect of the invention.

X. Ninth Aspect—Method of Screening

According to a ninth aspect, the invention also relates to a method of screening a plurality of first microdrops with a plurality of second microdrops in a microfluidic system comprising a plurality of capillary traps, each capillary trap having a first trapping zone and a second trapping zone, the first microdrops forming a first panel of microdrops that are identical or of which at least y are different and the second microdrops forming a second panel of microdrops of which at least z are different, said method comprising the steps consisting of:

(i) trapping a first microdrop in each first trapping zone, and (ii) trapping a second microdrop in each second trapping zone, the first and the second trapping zone of each capillary trap being arranged in such a way that the first and the second microdrop trapped in said capillary trap are in contact with one another in the latter, (iii) fusing each first microdrop with the second microdrop in contact therewith so as to obtain a panel of microdrops in the microfluidic system each corresponding to one combination among the different possible combinations of first and second microdrops.

Such a method allows rapid screening of a large number of reaction conditions in a single microfluidic system.

The fact that the microdrops are static during the reaction makes it easier to obtain kinetic data. There is also the advantage of economy of compounds, through the use of very small volumes in the microdrops.

The first panel of microdrops may comprise microdrops that are different at least in their contents, notably their concentration of a first compound of interest.

The second panel of microdrops may comprise microdrops that are different at least in their contents, notably their concentration of a second compound of interest.

The first or second microdrops may be obtained by the method according to the ninth aspect of the invention.

The first and second compounds may be compounds that react together and whose initial concentrations we wish to optimize. Thus, it will be possible to perform several reactions in parallel on a small volume in order to determine the initial concentrations of compounds giving the best results.

Preferably, the method comprises an additional step (iv) of observation or of measurement, notably by imaging, by colorimetric, fluorescence, spectroscopic (UV, Raman) or temperature measurement, before step (iii). Such a step makes it possible to map the disposition of the different microdrops.

Preferably, the method comprises an additional step (v) of observation or of measurement, notably by imaging, by colorimetric, fluorescence, spectroscopic (UV, Raman) or temperature measurement, after step (iii).

As a variant, the first panel of microdrops comprises proteins, the first microdrops being identical, and the second panel of microdrops comprises different concentrations of a solution allowing protein crystallization, notably a saline solution. The method may then make it possible to study protein crystallization as a function of the concentration of crystallization solution. In fact, the optimum crystallization conditions vary from one protein to another.

As a further variant, the first panel of microdrops comprises a compound, the first microdrops being identical and the second panel of microdrops comprises a titrating species at different concentrations. This application may be particularly advantageous in the case of assay of reagents that are expensive or available in small amounts.

As a further variant, the first panel of microdrops comprises one or more cells and the second microdrops each comprise a medicinal product to be screened at a defined concentration.

In a similar configuration, liver cells are cultured in the form of spheroids in the first microdrops, and a second microdrop containing a medicinal product at different concentrations, whose toxicity we wish to evaluate, is supplied in each of the second trapping zones.

By analyzing the results of viability a few days after coalescence of the microdrops it is possible to determine the concentration that kills half of the cellular population.

This method may also make it possible to evaluate the interactions between different antibiotics. It is possible to create microdrops forming a panel of microdrops having different concentrations of antibiotics A and B and fuse them with microdrops containing bacteria. The microdrops containing the bacteria may form a panel of microdrops with different concentrations of bacteria. This makes it possible to vary three different parameters in a single trapping chamber, namely the concentration of antibiotic A, the concentration of antibiotic B and the initial concentration of bacteria.

By using microfluidics it is in addition possible to use very small volumes, which may be very advantageous in the context of rare samples such as cells obtained from a biopsy. The system may for example be used in the context of personalized medicine and cancer treatment. With this system it is possible to culture, for example in the form of spheroids in the first microdrops, tumor cells from a patient who has undergone a biopsy and subject them to various active substances at multiple concentrations by supplying second microdrops. After fusion of the pairs of microdrops containing cells and active substances, it is possible to determine which active substance will be the most effective, and at what concentration, for a particular patient, using just a single chip and a minimum number of cells obtained from the biopsy.

Preferably, the first and the second trapping zones of one and the same capillary trap are configured so that the trapping forces that would be exerted by the first and by the second trapping zone on a same first or second liquid microdrop would be different.

One or more of the features described above in connection with the methods or devices according to the preceding aspects of the invention may apply to the method according to this aspect of the invention.

The method may be carried out using one of the microfluidic systems according to the preceding aspects.

Figure 1A:
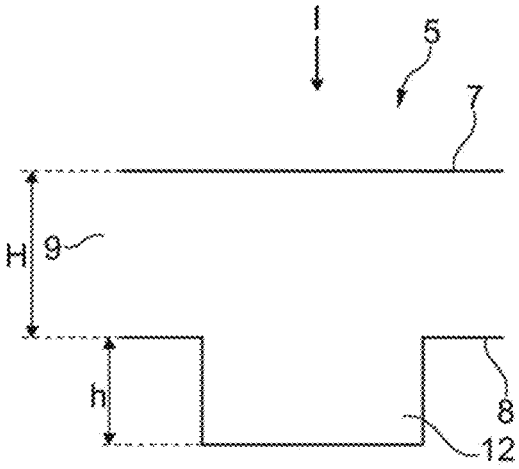
Figure 2:
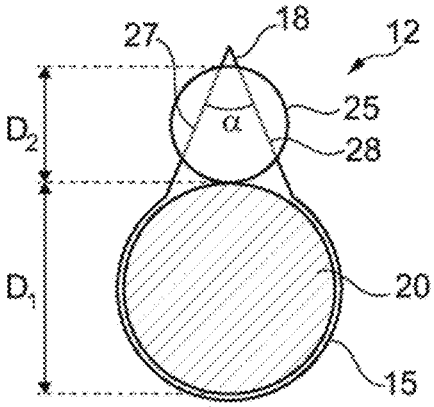
Figure 3:
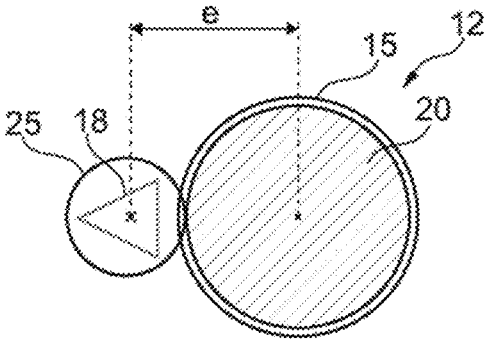
Figure 4:
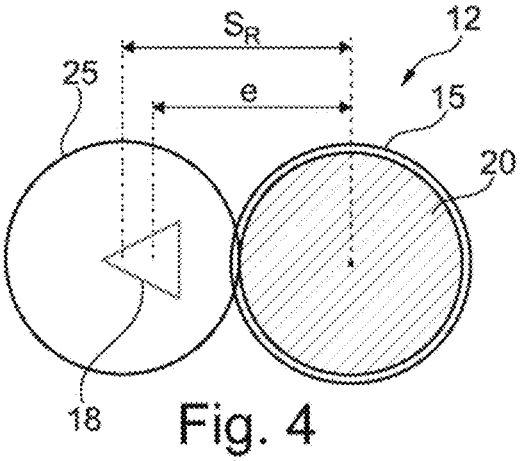
Figure 5A:
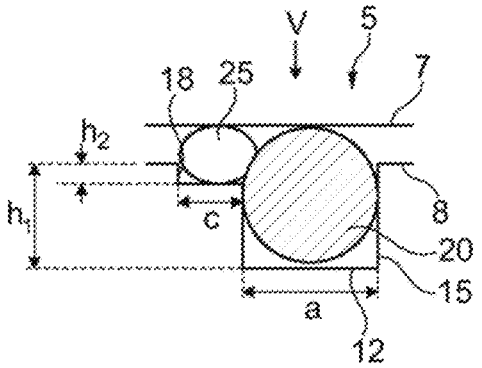
Figure 5B:
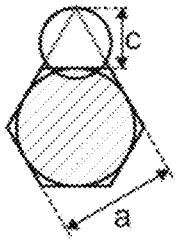
Figure 44:
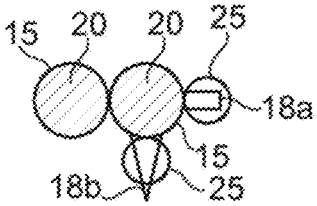
Figure 45:
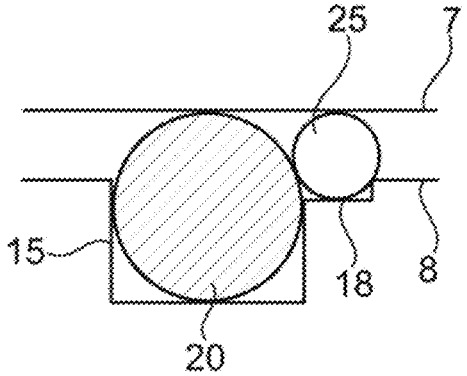
Figure 46:
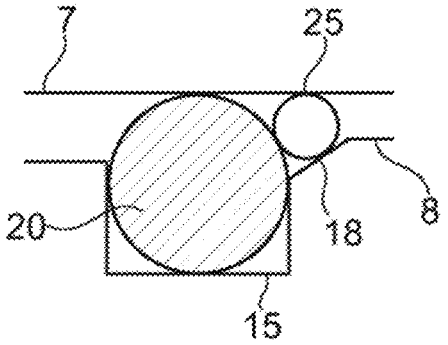
Figure 47:
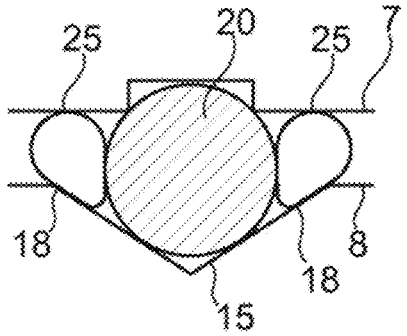
Figure 48:
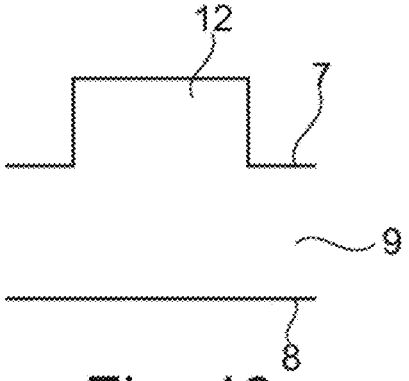
Figure 49:
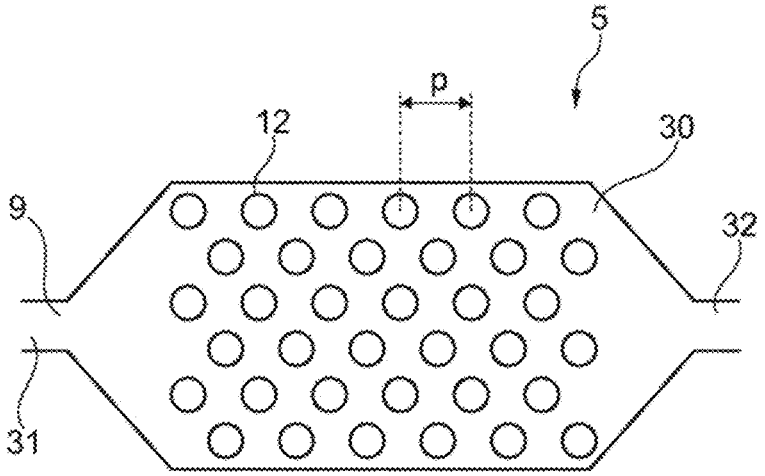
Figure 51:
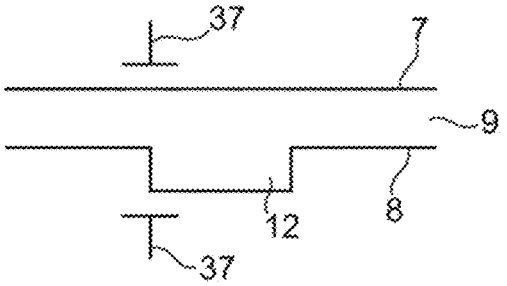
Figure 50:
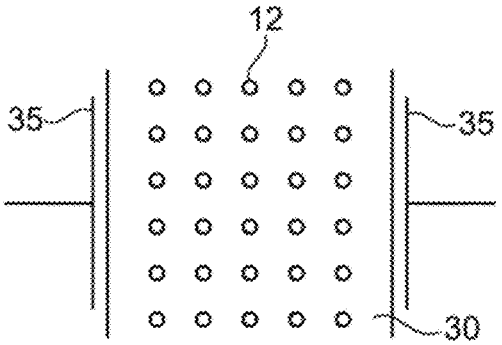
Figure 52:
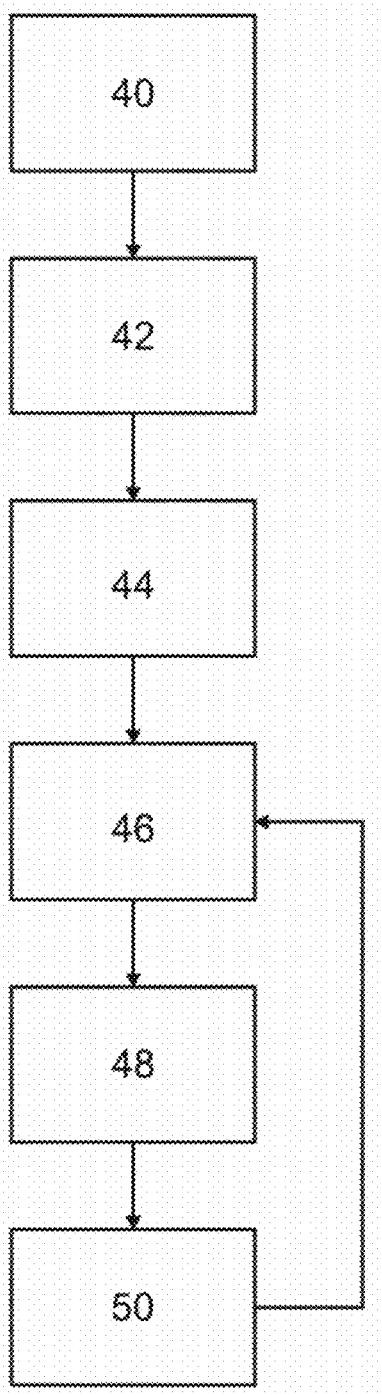
Figure 53:
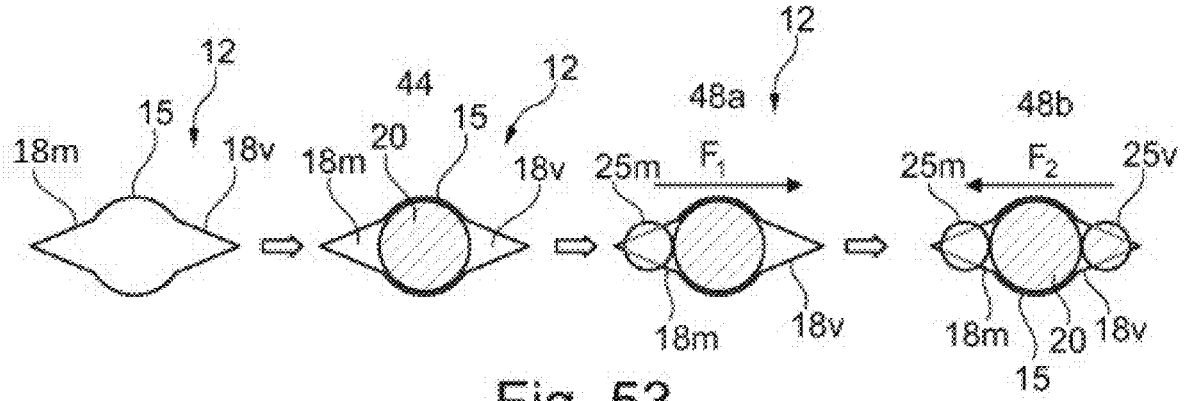
Figure 58:
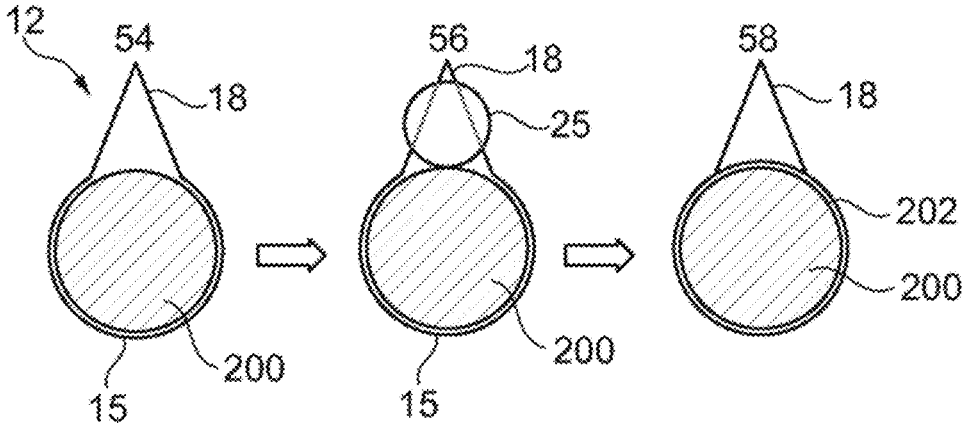
Figure 59:
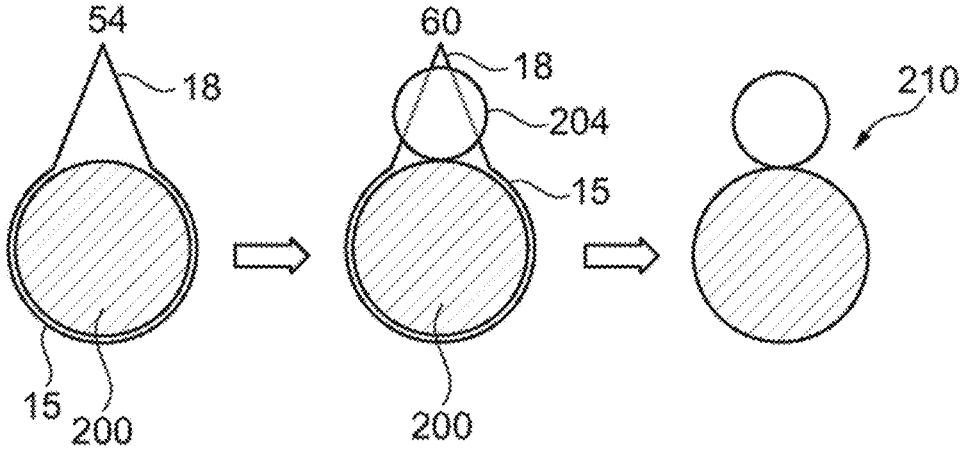
Figure 60:
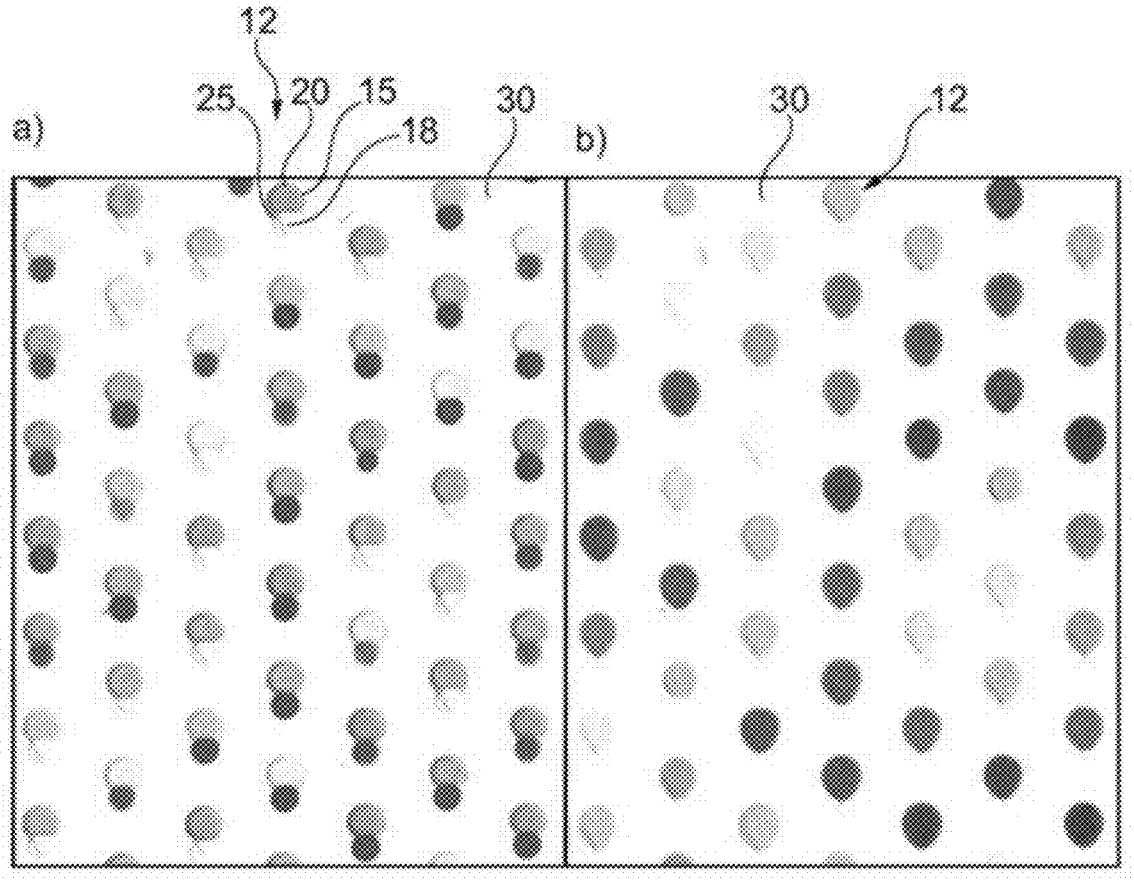
Figure 66:
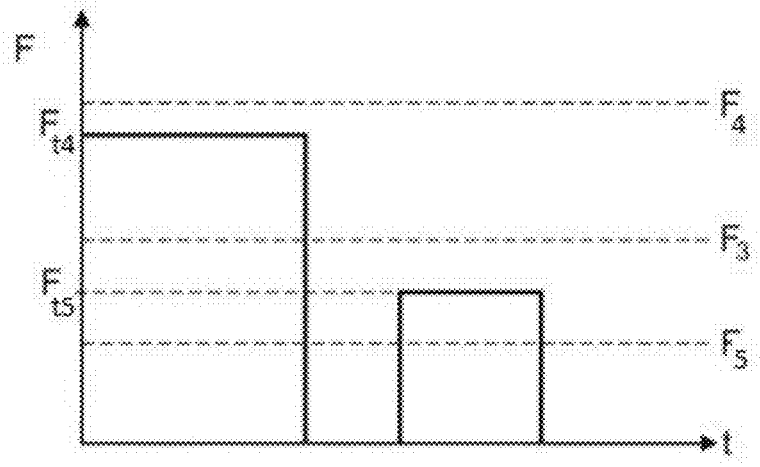
Figure 61A:
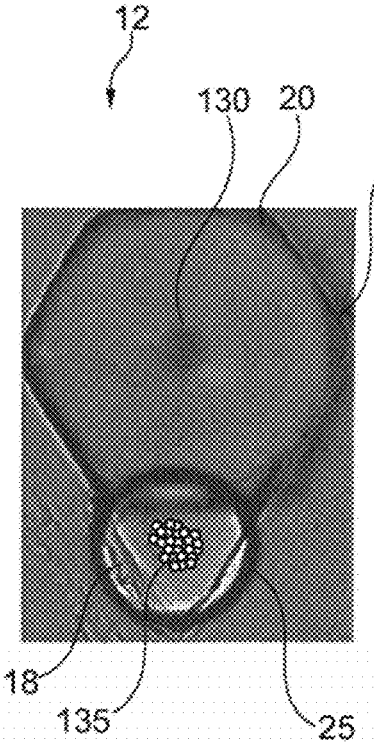
Figure 61B:
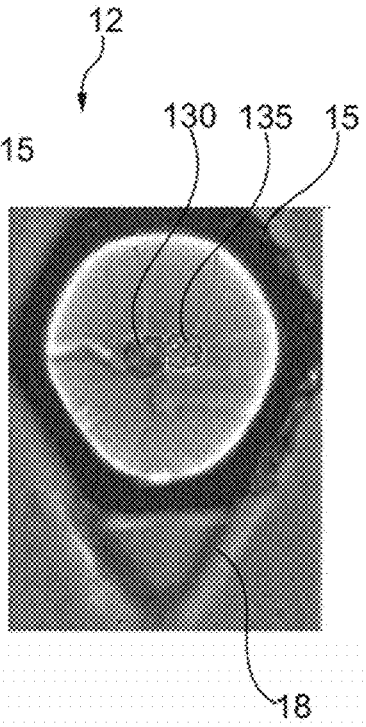
Figure 61C:
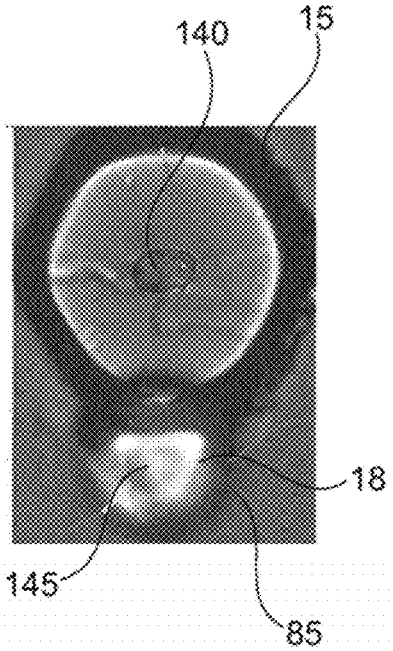
Figure 61D:
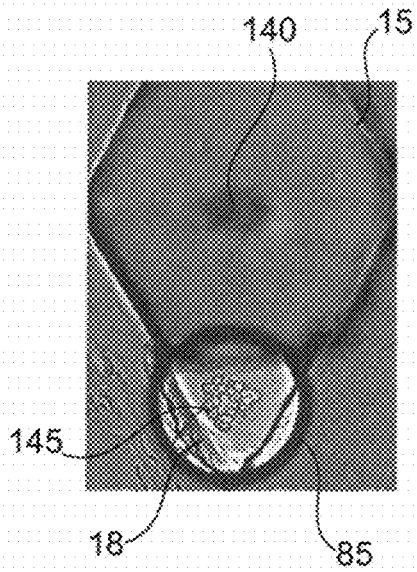
Figure 61E:
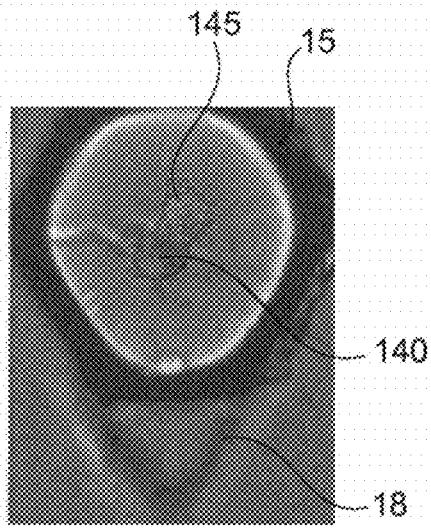
Figure 62:
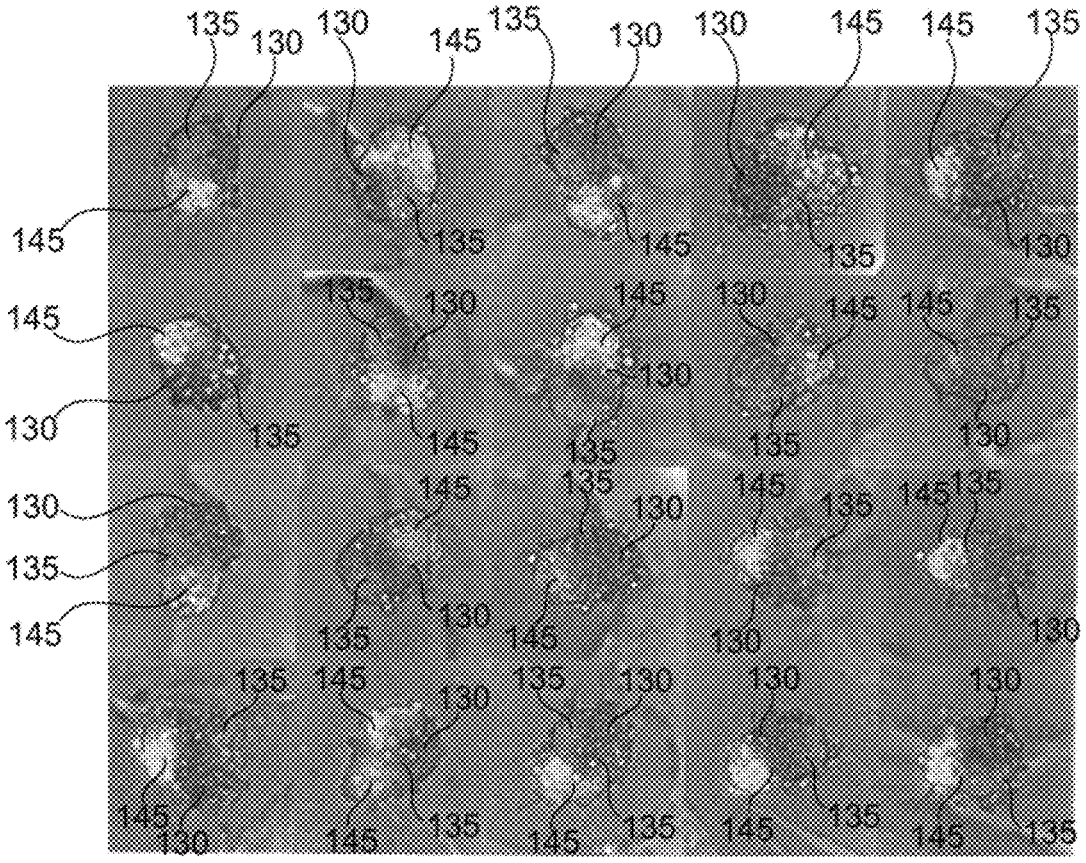
Figure 63:
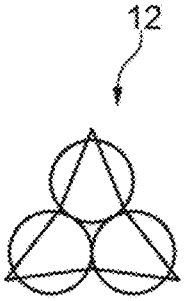
Figure 64:
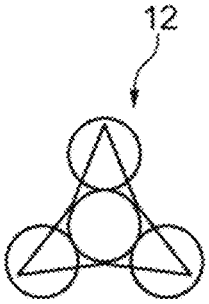
Figure 65:
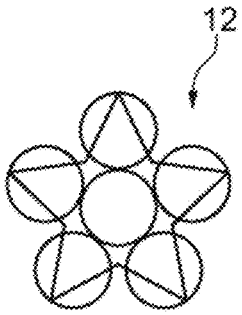

The invention may be better understood on reading the following description of nonlimiting embodiment examples of the invention, referring to the appended drawing, in which:

FIG. 1A shows a cross section of a capillary trap according to the invention, FIG. 1B is a top view along I of the capillary trap in FIG. 1A, FIG. 2 is a schematic top view of the capillary trap in FIG. 1 after trapping two microdrops, FIGS. 3 and 4 are variants, viewed from above, of capillary traps with microdrops, FIG. 5A shows a variant of capillary trap in cross section, FIG. 5B is a top view along V of the capillary trap in FIG. 5A, FIGS. 6 to 44 are variants, viewed from above, of capillary traps with microdrops, FIGS. 45 to 47 are, in cross section, variants of capillary traps with microdrops, FIG. 48 shows, in cross section, a variant of capillary trap, FIG. 49 shows schematically a trapping chamber, viewed from above, FIG. 50 is a schematic representation of a trapping chamber viewed from above, FIG. 51 is a cross-sectional view of a capillary trap, FIG. 52 is a schematic representation of a method according to the invention, FIG. 53 illustrates a variant method of manipulating the microdrops in a capillary trap according to the invention, FIGS. 54 to 59 illustrate variants of methods of manipulating microdrops in a capillary trap according to the invention, FIGS. 60 to 62 illustrate embodiment examples of the invention, FIGS. 63 to 65 illustrate variants of capillary traps, viewed from above, and FIG. 66 illustrates the capture of microdrops by an example of a capillary trap comprising two zones exerting different trapping forces on first and second microdrops.

The invention relates to a method for manipulating at least one first and one second microdrop in a microfluidic system.

The microfluidic system 5 comprises an upper wall 7 and a lower wall 8, between them forming a channel 9 for circulation of the microdrops and at least one capillary trap 12.

Capillary Trap

In the example illustrated in FIGS. 1A and 1B, the capillary trap 12 forms, in cross section of the microfluidic system, a cavity in the lower wall 8 of constant height in which microdrops may lodge. Viewed from above, it has a first trapping zone 15 of circular shape, with a second trapping zone 18 of triangular shape adjacent to it.

The first and the second trapping zones 15 and 18 exert different trapping forces on a given microdrop, in particular owing to their difference in shape. Here, the first trapping zone 15 exerts a larger trapping force than the second trapping zone 18.

When a first microdrop 20 is introduced into the microfluidic system it is trapped in the trapping zone having the largest trapping force for this microdrop, in this case the first trapping zone 15. When the second microdrop 25 is introduced it is trapped in the free trapping zone, here the second trapping zone 18, as is illustrated in FIG. 2.

In the figures, the first microdrops 20 are shown in black and the second microdrops 25 are shown transparent, but without this representing a particular difference in contents between the two microdrops.

The first trapping zone 15 has a diameter a approximately equal to the apparent diameter $D_1$, viewed from above, of the first microdrop 20, once trapped in the first trapping zone.

The two trapped microdrops 20 and 25 are in contact with one another notably on account of the small distance between the two trapping zones 15 and 18 relative to the diameters of the two microdrops 20 and 25. Moreover, the two microdrops 20 and 25 are kept in contact owing to the triangular shape of the second trapping zone 18. In fact, the second microdrop 25, being in contact with two opposite walls 27 and 28 of the second trapping zone 18 moving away from one another in the direction of the first trapping zone 15, is caused, through its natural tendency to always minimize its surface energy, to move in translation between the two opposite walls 27 and 28 in the direction of widening of the walls 27 and 28, i.e. toward the first trapping zone 15 and therefore the first microdrop 20.

In FIGS. 1A and 2, the two walls 27 and 28 form between them a divergence angle $\alpha$ approximately equal to 45°.

In the example illustrated in FIG. 2, the first microdrop 20 has a diameter $D_1$ greater than that $D_2$ of the second microdrop 25.

The second trapping zone 18 exerts a trapping force on the second microdrop 25 that is greater than what it would exert on the first microdrop 20. In fact, although the design of the second trapping zone is the same regardless of the diameter of the microdrop, the diameter of the second microdrop 25 adapts better to the shape and size of the second trapping zone 18 than of the first microdrop 20. However, it may be otherwise, and the second microdrop 25 may be of the same diameter as the first microdrop 20.

As a variant, the first microdrop and the second microdrop 20 and 25 are different from one another with respect to another of their properties, notably their surface state, their viscosity or their weight.

As a variant illustrated in FIGS. 3 and 4, the capillary trap 12 comprises two juxtaposed separate cavities forming the first trapping zone 15 of circular shape and the second trapping zone 18 of triangular shape, respectively. The two trapping zones 15 and 18 of the capillary traps are close enough for the two trapped microdrops 20 and 25 to be in contact with one another. Preferably, the distance e between the centers of gravity of the trapping zones 15 and 18 is less than, as illustrated in FIG. 4, or equal to, as illustrated in FIG. 3, the sum $S_R$ of the radii of the two microdrops.

As a variant, illustrated in FIGS. 5A and 5B, the first trapping zone may be of hexagonal shape and the first trapping zone 15 may have a height $h_1$ different from that $h_2$ of the second trapping zone 18, notably $h_1$ is greater than $h_2$. The first trapping zone 15 then exerts a larger trapping force than the second trapping zone 18.

Figure 6:
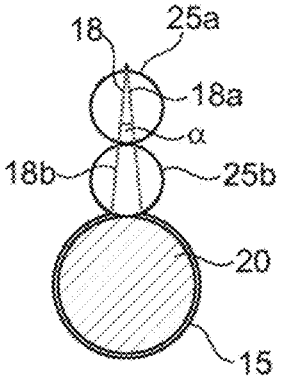

As a variant illustrated in FIG. 6, the second trapping zone 18 has the shape of a long triangle having a small divergence angle α, here approximately equal to 10°, making it possible to trap a string of second microdrops 25, here two second microdrops 25*a* and 25*b*, in contact with one another. It may then be considered that the second trapping zone 18 is in fact made up of two second trapping zones 18*a* and 18*b* so that each is able to trap a second microdrop 25*a* and 25*b*. The second microdrop 25*a* is in this case joined to the first drop 20 via the second microdrop 25*b*. The trapping forces that the second trapping zones 18*a* and 18*b* exert on the second microdrops 25*a* and 25*b* may be different depending on their positions. Here, the second trapping zone 18*b* exerts a stronger trapping force on the second microdrop 25*b* closest to the first trapping zone 15. However, it could be otherwise, depending on the shape of the second trapping zone 18.

As a variant, not illustrated, the two second trapping zones 18*a* and 18*b* may exert identical forces on the second trapped microdrops 25*a* and 25*b*.

As a variant, not illustrated, the capillary trap may have more than two second trapping zones configured to form a string of trapped second microdrops, itself in contact, via at least one of the second microdrops forming it, with the first microdrop trapped in the first trapping zone.

It is thus possible to envisage more complex shapes of capillary traps comprising a plurality of trapping zones configured so that the trapped microdrops are all joined together directly or via other microdrops.

Figure 7:
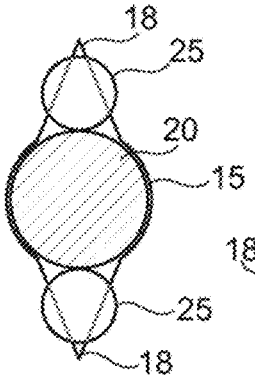
Figure 8:
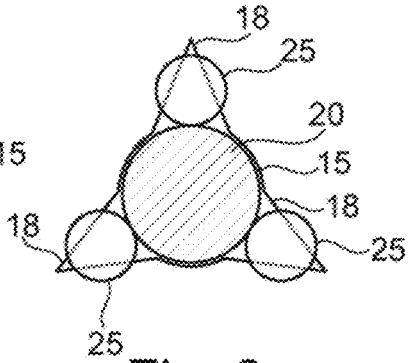
Figure 9:
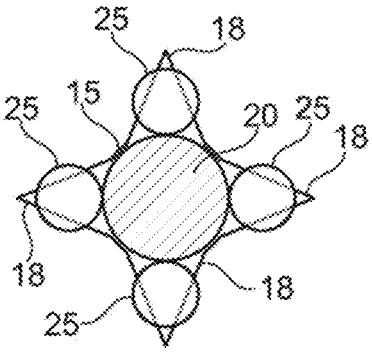

As a variant illustrated in FIGS. 7 to 9, the capillary trap 12 has a plurality of second identical trapping zones 18 distributed around the first trapping zone 15 in such a way that each second microdrop 25 trapped by one of the second trapping zones 18 is in contact with the first microdrop 20.

The second trapping zones 18 may be uniformly distributed around the first trapping zone 15, as is illustrated. However, it may be otherwise.

Figure 10:
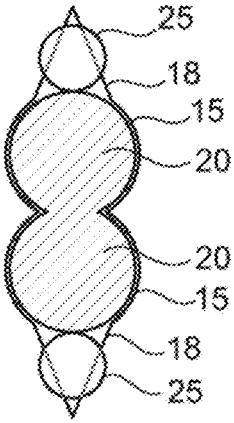

As a variant illustrated in FIG. 10, the capillary trap 12 has a plurality of first trapping zones 15 arranged in such a way that the first microdrops trapped by the latter are each in contact with at least one other first microdrop and a plurality of second trapping zones 18. Here, the capillary trap 12 has two first fused trapping zones 15 and two second trapping zones, one fused to each first trapping zone.

Figure 11:
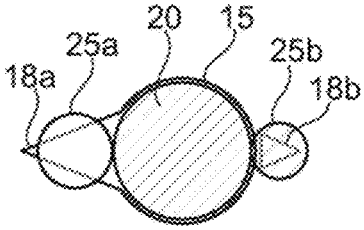

As a variant illustrated in FIG. 11, the capillary trap 12 may have a plurality of second trapping zones 18*a* and 18*b* of different shapes. The second trapping zones may be intended to receive different second microdrops 25*a* and 25*b*. For example, as illustrated, the capillary trap has a second trapping zone 18*a* forming a single cavity with the first trapping zone 15 and a second trapping zone 18*b* separate from the first trapping zone 15. The second trapping zones 18*a* and 18*b* exert different trapping forces on one and the same microdrop. The second trapping zone 18*a* is intended to trap a second microdrop 25*a* with a diameter larger than that of the second microdrop 25*b* trapped by the second trapping zone 18*b*.

The invention is not limited to the examples of shape of the capillary trap 12 described above. The capillary trap 12 may have various shapes, notably as a function of the required application. FIGS. 12 to 45 illustrate conceivable shapes.

Figure 12:
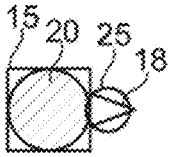

For example, as illustrated in FIG. 12, the first trapping zone 15 may be of polygonal shape, notably square, and the second trapping zone 18 of triangular shape and fused to one side of the square.

Figure 13:
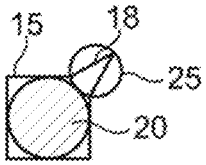

As a variant illustrated in FIG. 13, the second trapping zone 18 is fused to a corner of the square forming the first trapping zone 15.

Figure 14:
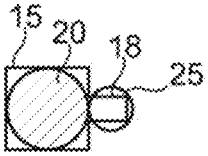

As a variant illustrated in FIG. 14, the second trapping zone 18 is of rectangular shape, notably square.

Figure 15:
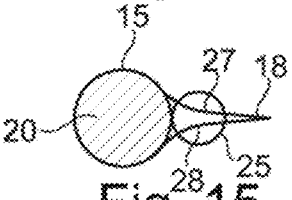

As illustrated in FIG. 15, the second trapping zone 18 may become wider in the direction of the first trapping zone 15 and may have opposite walls 27 and 28 having a curved profile in top view, the second trapping zone 18 tapering toward its end.

Figure 16:
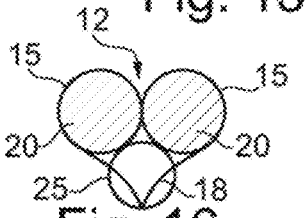

As illustrated in FIG. 16, the capillary trap 12 may be heart-shaped, the lobes of the heart forming two first trapping zones 15 and the tip of the heart forming the second trapping zone 18.

Figure 17:
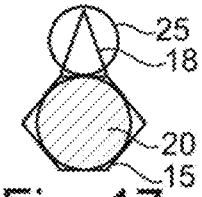

As illustrated in FIG. 17, the first trapping zone 15 may be of pentagonal shape, the second trapping zone 18 extending from a corner of the pentagon.

Figure 18:
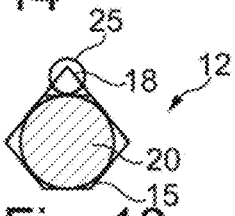

As illustrated in FIG. 18, the capillary trap 12 may be of hexagonal shape, the second trapping zone 18 extending from a side of the hexagon.

Figure 19:
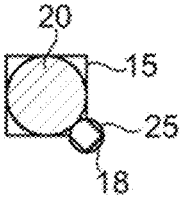
Figure 20:
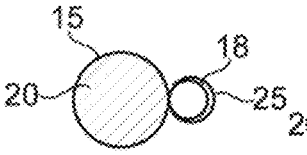

The first trapping zone 15 may be of square shape, as illustrated in FIG. 19, or of circular shape, as illustrated in FIG. 20, and the second trapping zone 18 may be of circular shape.

Figure 21:
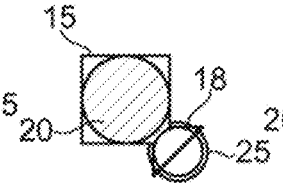

As a variant, the second trapping zone 18 is of triangular shape but joined to the first trapping zone 15 by one of its corners, as illustrated in FIG. 21. The second trapping zone 18 therefore becomes wider outwards.

Figure 22:
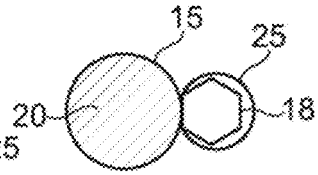

As a further variant, the second trapping zone 18 is of polygonal shape, notably hexagonal, as illustrated in FIG. 22.

Figure 33:
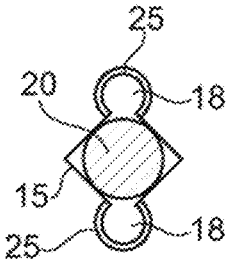

As a further variant, the capillary trap 12 may comprise two second trapping zones 18 fused to the first trapping zone 15 at opposite corners of the latter, as illustrated in FIG. 33.

Figure 23:
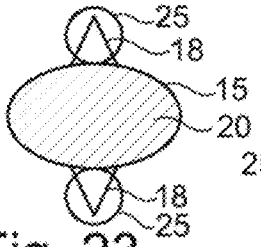

As illustrated in FIG. 23, the capillary trap 12 may have a first trapping zone 15 of oval shape and two second trapping zones 18 of triangular shape fused to the first trapping zone and extending opposite one another on either side of the latter starting from the longer sides of the oval.

Figure 34:
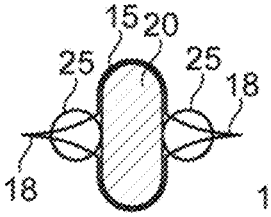

As a variant illustrated in FIG. 34, the second trapping zones 18 are of the same shape as that in FIG. 15

Figure 24:
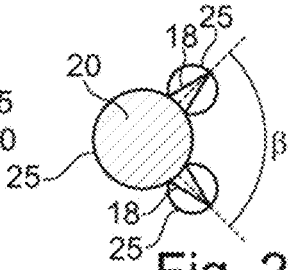

As illustrated in FIG. 24, the capillary trap 12 may have two second trapping zones 18 not uniformly distributed around the first trapping zone 15 but forming a spacing angle β between them.

Figure 25:
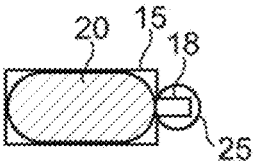
Figure 26:
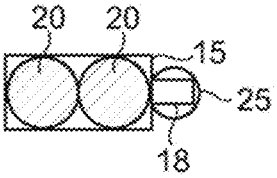

The first trapping zone 15 may be of rectangular shape and the second trapping zone 18 of square shape fused to the first trapping zone 15 by a short side of the rectangle. Depending on the size of the first microdrops 20, the first trapping zone 15 may then trap a single first microdrop 20, as illustrated in FIG. 25, or a plurality of first microdrops 20, as illustrated in FIG. 26

Figure 27:
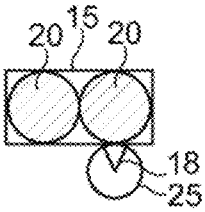

As a variant illustrated in FIG. 27, the second trapping zone 18 may be fused to the first trapping zone 15 by one of the long sides of the rectangle.

Figure 28:
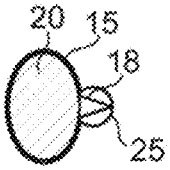
Figure 29:
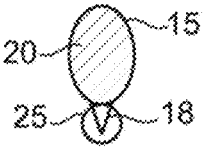

The first trapping zone 15 may be of oval shape and the second trapping zone 18 may be fused to the latter starting from its long side, as illustrated in FIG. 28, or by its short side, as illustrated in FIG. 29.

Figure 30:
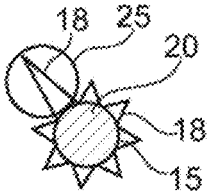

The capillary trap may comprise a plurality of second trapping zones 18, at least two of which are different, notably by their sizes, as is illustrated in FIG. 30.

Figure 31:
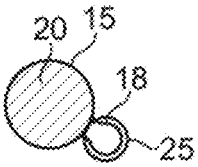

In the example illustrated in FIG. 31, the capillary trap 12 has the shape of a calabash gourd whose base forms the first trapping zone 15 and the head forms the second trapping zone 18.

Figure 32:
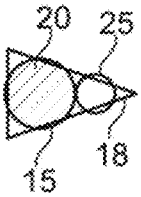

As a variant illustrated in FIG. 32, the capillary trap 12 is of triangular shape, the part near the wider base forming the first trapping zone 15 and the vertex forming the second trapping zone 18.

Figure 35:
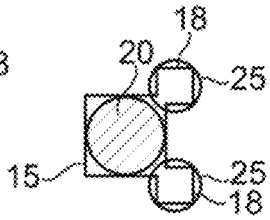
Figure 36:
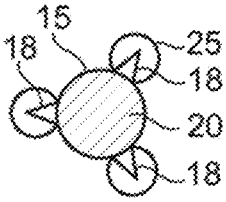
Figure 37:
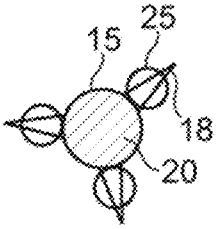
Figure 38:
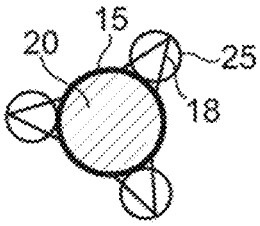
Figure 39:
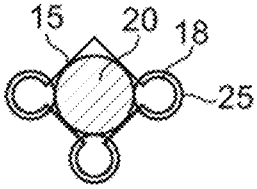
Figure 40:
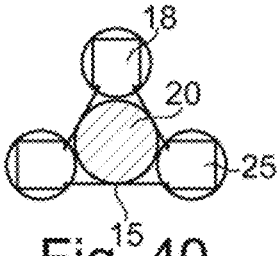
Figure 41:
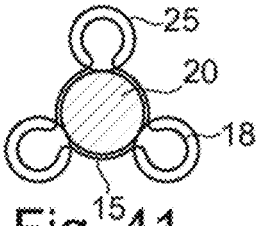

In the example illustrated in FIG. 35, the first trapping zone 15 is of square shape and the capillary trap 12 has two second trapping zones 18 of identical square shape each fused by one of their corners to a corner of the first trapping zone 15.

In the examples illustrated in FIGS. 36 to 41, the capillary trap 12 has three second trapping zones 18, and the first and the second trapping zones 15 and 18 may each have all the shapes described above.

Figure 42:
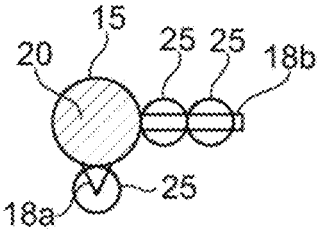
Figure 42:
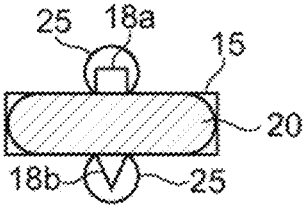
Figure 43:
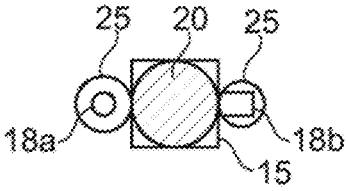

In the examples illustrated in FIGS. 42 to 44, the capillary trap 12 has a plurality of second trapping zones that are of different shapes. For example, one of the second trapping zones 18*a* is of triangular shape and the other of the second trapping zones 18*b* is of rectangular shape, the rectangle being long enough to form a plurality of second trapping zones and trap a string of second microdrops 25, as is illustrated in FIG. 42, or the second trapping zones may have the shapes described above.

In cross section, the first trapping zone 15 and the second trapping zone 18 may be of constant height over their entire width.

As a variant illustrated in FIG. 45, the first trapping zone 15 has, in cross section, an edge sloping toward the bottom of the cavity.

As a further variant illustrated in FIG. 46, the second trapping zone 18 has a wall inclined toward the first trapping zone. This notably makes it possible to keep the second microdrop 25 in contact with the first microdrop 20.

As a further variant illustrated in FIG. 47, the first and the second trapping zones have at least one inclined wall.

As a variant illustrated in FIG. 48, the capillary trap 12 is formed at least partially by a cavity of the upper wall 7 of the microfluidic system.

As a variant, the capillary trap 12 is formed at least partially by a cavity of one of the side walls of the microfluidic system.

As a variant illustrated in FIG. 47, the capillary trap is formed both by a cavity of the lower wall 8 and of the upper wall 7.

As a variant illustrated in FIGS. 63 to 65, the capillary trap is anisotropic and it comprises a plurality of trapping zones having an identical trapping force, so that the capillary trap traps a plurality of identical microdrops in its various zones. For example, as illustrated in FIGS. 61 and 62, the capillary trap 12 may be of approximately triangular shape and may trap, depending on the size of the microdrops, 3 or 4 identical microdrops. As a variant illustrated in FIG. 63, the capillary trap 12 has the shape of a star with five arms and is able to trap 5 or 6 identical microdrops.

Microfluidic Device

The channel 9 for circulation of the microdrops may comprise a plurality of capillary traps 12.

In particular, channel 9 may comprise a two-dimensional trapping chamber 30 in which the capillary traps 12 are distributed spatially according to two spatial directions in a table or matrix, as illustrated in FIG. 49. In this figure, the capillary traps 12 are arranged at equal distance from one another in the form of a plurality of arrays, but it may be otherwise. They may be arranged according to any scheme, periodical or not.

The number of capillary traps 12 in the trapping chamber 30 may range from a single one per chamber to several thousand per $cm^2$.

The distance p defined between the centers of gravity of the capillary traps 12 is preferably greater than or equal to the size of the largest microdrops intended to be trapped, notably greater than or equal to the apparent diameter, viewed from above, of a first drop confined in the channel between the walls 7 and 8 outside of the capillary traps, for example between 20 μm and 1 cm.

The number of capillary traps may be greater than or equal to 200 capillary traps per $cm^2$, better still 2000 capillary traps per $cm^2$. Thus, controlled combination of microdrops may be performed in hundreds, or even tens of thousands of traps in parallel in the same trapping chamber 30.

The capillary traps 12 may be as described above.

The capillary traps 12 may all be identical.

As a variant, at least two capillary traps 12 may be different, notably by their shapes, sizes, heights or orientations, or by the number, shape, height or orientation of the first and second trapping zones 15 and 18. This makes it possible to have different conditions as a function of the capillary trap 12.

As a variant that is not illustrated, channel 9 may be one-dimensional and comprise an array of capillary traps 12 distributed along its length.

The invention is not limited to the shapes of microfluidic system described above. The microfluidic system may have different shapes, notably as a function of the required application.

Microdrops

Preferably, channel 9 is filled with a fluid in which the microdrops are immiscible. This fluid may be stationary or moving. When the latter is moving, the stream of fluid is preferably oriented along the lines of fluid circulation (not shown) and circulates from a fluid inlet 31 to a fluid outlet 32.

The microdrops are, for example, aqueous microdrops in an oily liquid or microdrops of oil in an aqueous liquid.

Preferably, the first and second microdrops 20 and 25 have diameters $D_1$ and $D_2$ of the order of a micrometer, notably between 20 and 5000 μm.

The first microdrops 20 are preferably different from the second microdrops 25, notably with respect to their sizes and/or their compositions.

The first microdrops 20, or the second microdrops 25, may form a panel of microdrops, at least a certain number of which are different.

The first and/or the second microdrops 20 and 25 may comprise an identifying compound allowing them to be identified before, during and/or after coalescence of the first and second microdrops 20 and 25 in contact. This or these identifying compound(s) may be for example a certain number of beads or particles, compounds of varied colors or shapes or compounds emitting a colorimetric or fluorescence signal proportional to their concentration in the microdrop. In the case of a panel of first microdrops and/or a panel of second microdrops comprising a compound of interest in different concentrations and/or different compounds of interest, it is thus possible to associate the position of a first and/or second microdrop in the trapping chamber with its composition in order to map the microdrops trapped in the trapping chamber.

As a variant, the identifying compound or compounds of the first microdrops interact with one or more identifying compounds of the second microdrops so as to allow identification of the microdrop obtained after fusion. For example, fusion of the microdrops may lead to a chemical reaction, at least one of the products of which may be identified.

Preferably, channel 9 is filled with a fluid containing a surfactant. The latter allows stabilization of the microdrops and reproducibility of their formation. The surfactants in addition make it possible to prevent spontaneous coalescence of the microdrops in the case of contact while they are conveyed from the production device to the capillary traps or in the capillary traps.

For aqueous microdrops, the surfactant is for example a compound selected from PEG-di-Krytox in a fluorinated oil or SPAN®80 in a mineral oil.

For microdrops of oil, the surfactant is for example sodium dodecyl sulfate.

As a variant, the microdrops are stabilized by some other means, notably the microdrops may be gelled, or stabilized by adsorption of amphiphilic nanoparticles as described in the article of Pan, M., Rosenfeld, L., Kim, M., Xu, M., Lin, E., Derda, R., & Tang, S. K. Y. (2014). Fluorinated Pickering Emulsions Impede Interfacial Transport and Form Rigid Interface for the Growth of Anchorage-Dependent Cells. Applied Materials & Interfaces, 6, 21446-21453, incorporated here by reference.

Method of Manipulation

An example of a method of manipulating the first and second microdrops is illustrated in FIG. 52.

The first microdrops 20 are produced in step 40. Many methods have already been proposed for forming these first microdrops in a mobile phase. For example, the following examples of methods may be mentioned:

a) the method called "flow-focusing" described for example in S. L. Anna, N. Bontoux and H. A. Stone, "Formation of dispersions using 'Flow-Focusing' in microchannels", Appl. Phys. Lett. 82, 364 (2003), the contents of which are incorporated here by reference, b) the method called "step emulsification" described for example by R. Seemann, M. Brinkmann, T. Pfohl, and S. Herminghaus, in "Droplet based microfluidics." Rep. Prog. Phys., Vol. 75, No. 1, p. 016601, January 2012, the contents of which are incorporated here by reference, c) the method combining the methods of "flow-focusing" and "step emulsification", described for example by V. Chokkalingam, S. Herminghaus, and R. Seemann, in "Self-synchronizing pairwise production of monodisperse droplets by microfluidic step emulsification," Appl. Phys. Lett., Vol. 93, No. 25, p. 254101, 2008, the contents of which are incorporated here by reference, d) the method called "T junction" described for example by G. F. Christopher and S. L. Anna, in "Microfluidic methods for generating continuous droplet streams," *J. Phys. D. Appl. Phys.*, Vol. 40, No. 19, pp. R319-R336, October 2007, the contents of which are incorporated here by reference, e) the method called "confinement gradient" described for example by R. Dangla, S. C. Kayi, and C. N. Baroud, in "Droplet microfluidics driven by gradients of confinement," Proc. Natl. Acad. Sci. U.S.A., Vol. 110, No. 3, pp. 853-8, January 2013, the contents of which are incorporated here by reference, or f) the method of "micro-segmented flows" described for example by A. Funfak, R. Hartung, J. Cao, K. Martin, K. H. Wiesmüller, O. S. Wolfbeis, and J. M. Köhler, in "Highly resolved dose-response functions for drug-modulated bacteria cultivation obtained by fluorometric and photometric flow-through sensing in microsegmented flow," Sensors Actuators, B Chem., Vol. 142, No. 1, pp. 66-72, 2009, the contents of which are incorporated here by reference, in which two solutions in different controlled proportions are mixed at the level of a function outside the microfluidic system to form microliter drops separated by an immiscible phase and then a method of dividing these drops into microdrops by injecting them for example into a microfluidic system containing a slope.

These methods notably make it possible to form a plurality of microdrops of approximately equal dimensions. The dimensions of the microdrops obtained may be controlled by modifying the parameters of formation of the microdrops, notably the velocity of circulation of the fluids in the device and/or the shape of the device.

The first microdrops 20 may be produced on the same microfluidic system as the method or on a different device. In the latter case, the first microdrops 20 may be stored in one or more external containers before being injected into the microfluidic system. These first microdrops 20 may all be identical or some of them may be of different compositions, concentrations and/or sizes.

After formation of these first microdrops 20, the latter may be conveyed to the capillary trap 12 by entrainment by a stream of a fluid and/or by slopes or reliefs in the form of rails of the channel 9. In both cases, the addition of rails may make it possible to optimize the filling of the capillary trap 12, selectively, for example in combination with the use of an infrared laser, as described by E. Fradet, C. McDougal, P. Abbyad, R. Dangla, D. McGloin, and C. N. Baroud, in "*Combining rails and anchors with laser forcing for selective manipulation within 2D droplet arrays,*" *Lab Chip*, Vol. 11, No. 24, pp. 4228-34, December 2011.

If production of the microdrops is carried out outside the microfluidic system, they may be transported from storage to the microfluidic system directly via a tube connecting for example the production system and the trapping system or by aspiration and injection with a syringe.

The first microdrops 20 are entrained in the microfluidic system in such a way that the entraining force to which they are subjected is less than the trapping force of the first trapping zones 15 on the first microdrops 20. The first microdrops 20 are then trapped, in step 42, in the capillary trap 12, in particular in the first trapping zones 15. If the entraining stream exerts on the first microdrops 20 an entraining force on the first microdrops 20 that is greater than the trapping force of the second trapping zones 18, the latter are not trapped in the second trapping zones 18 that remain free.

Otherwise the first microdrops 20 may be trapped in the second trapping zones 18, especially if the sizes of the traps and of the drops are suitable. It is then possible to remove them from the latter by increasing the entraining force applied to all of the first microdrops 20, for example by increasing the velocity of the stream of fluid or, when there is none, by adding a stream of fluid in a step 44.

As a variant, the first microdrops 20 may be formed by a method called "breaking of the drops in capillary traps" described for example in international application WO 2016/059302, the contents of which are incorporated here by reference. In this case, the first microdrops 20 are formed directly in the first trapping zones 15.

The second microdrops 25 are produced in step 46. This step is shown after step 44 but it could take place beforehand. The second microdrops 25 may be produced and introduced into the microfluidic system as described above in relation to the first microdrops 20.

The second microdrops 25 are entrained in the microfluidic system in such a way that the entraining force to which they are subjected is less than the trapping force of the second trapping zones 18 on the second microdrops 25. The second microdrops 25 are then trapped, in step 48, in the second trapping zones 18. When the second microdrops 25 are entrained by a stream of fluid, the latter exerts an entraining force on the first microdrops 20 trapped in the first trapping zones 15 that is preferably less than or equal to the trapping force of the first trapping zones 15 on the first microdrops 20 so that the latter remain trapped.

At each stage, the method may comprise a step of first measurement of the state of the system. This measurement may be simple imaging, or for example colorimetric, fluorescence, spectroscopic (UV, Raman) or temperature measurement. This measurement may be particularly useful in the context of using panels of different first and/or second microdrops 20 comprising an identifying compound as described above.

When several microdrops are in contact in one and the same trap, it is possible to fuse them in a controlled manner to mix their contents in step 50. This coalescence may or may not be selective.

To fuse all of the microdrops in contact in the microfluidic system, notably in the trapping chamber 30, the latter is perfused with a surfactant-free fluid. The concentration of surfactant in the fluid of the microfluidic system decreases, which makes it possible to shift the equilibrium of adsorption of surfactant at the interface toward desorption. The microdrops lose their stabilizing effect and fuse spontaneously with the microdrops with which they are in contact.

As a variant, the microfluidic system is perfused with a fluid containing a destabilizing agent. The destabilizing agent is for example 1H,1H,2H,2H-perfluorooctan-1-ol in a fluorinated oil in the case of aqueous microdrops.

As a further variant, all of the microdrops in contact in the microfluidic system, notably in the trapping chamber 30, are fused by applying an external physical stimulus, such as mechanical waves, pressure waves, a temperature change or an electric field. As is illustrated in FIG. 50, the electrodes 35 may be placed on either side of the trapping chamber so as to fuse all of the microdrops in contact between the latter.

To fuse the microdrops selectively, an infrared laser may be used, as described by E. Fradet, P. Abbyad, M. H. Vos, and C. N. Baroud, in "*Parallel measurements of reaction kinetics using ultralow volumes,*" *Lab Chip*, Vol. 13, No. 22, pp. 4326-30, October 2013, or localized electrodes 37 at the level of the interfaces of microdrops between the trapping zones may be activated, as illustrated in FIG. 51, or mechanical waves may be focused on one or more points.

The invention is not limited to the examples of coalescence described above. Any method making it possible to destabilize the interface between two microdrops in contact may be used for fusing the microdrops.

It is then possible to measure the state of the microdrops obtained and/or observe the latter in real time. This makes it possible, for example, to study the kinetics of chemical or biochemical reactions.

Selective Trapping

When the capillary trap or traps 12 have a plurality of second trapping zones 18, the position of the second trapping zone or zones 18 relative to the direction and the sense of the entraining force being exerted on the second microdrops 25 may allow selective trapping to be carried out.

Take the case of a capillary trap with two second trapping zones 18*m* and 18*v* arranged on either side of a first trapping zone 15 and aligned in the direction of the entraining force exerted, as illustrated in FIG. 53. After trapping the first microdrop 20 at the level of the first trapping zone 15 according to step 44, second microdrops 25*m* are supplied with an entraining force oriented in the direction $F_1$ according to a step 48*a*. If the trapping forces in the second trapping zones 18*m* and 18*v* are low enough, a second microdrop 25*m* is only trapped in the second trapping zone 18*m* located upstream of the first trapped microdrop 20 relative to the direction $F_1$. Even if the second trapping zone 18*v* downstream is identical, its situation with respect to the second microdrops 25*m* is different because, in the case of a fluid, the lines of circulation of second microdrops 25, in bypassing the first microdrop 20, avoid the second trapping zone 18*v*. Moreover, keeping the second microdrop 25*m* trapped upstream is promoted by the presence of the first trapped microdrop 20, on which it may rest. After trapping a second microdrop 25*m* upstream, it is possible to exert an entraining force oriented in a direction $F_2$ opposite to $F_1$ on second microdrops 25*v* to trap one of the latter in the second trapping zone 18*v* that is still free, according to a step 48*b*.

Figure 54:
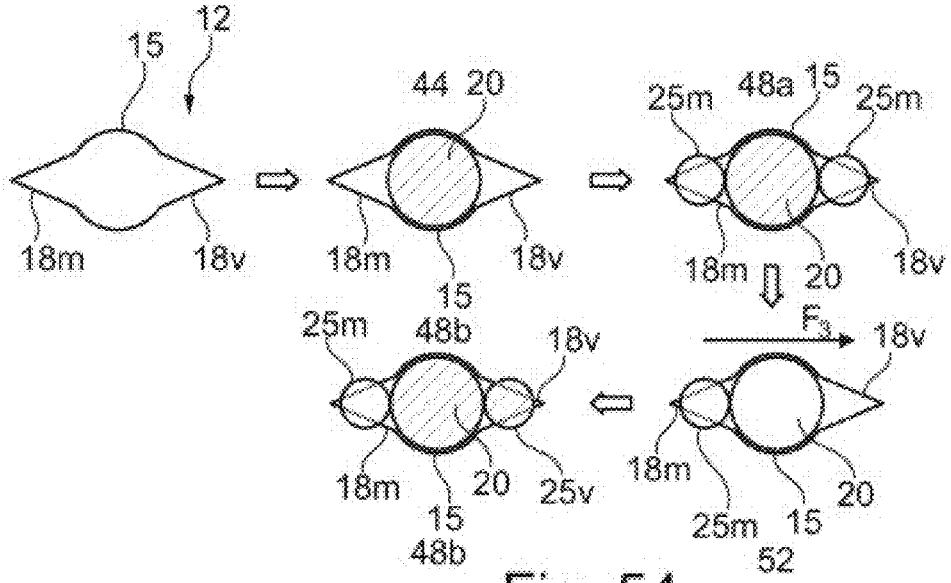

As is illustrated in FIG. 54, it is also possible to use the position of the second trapping zone or zones 18 relative to the direction and the sense of the entraining force being exerted on the second microdrops 25 to perform selective release in order for example to trap another different second microdrop 25 in one or more of the second trapping zones 18. Take the case of the preceding capillary trap, if the trapping forces in the second trapping zones 18*m* and 18*v* are each strong enough to trap a second microdrop 25*m* regardless of the direction of the entraining force exerted on the second microdrops 25*m* in step 48*a*, the fact that the second microdrop 25*m* upstream relative to an entraining force oriented in the direction $F_3$ is better retained than that downstream when such an entraining force is applied may be utilized for selectively releasing the second microdrop 25*m* trapped downstream according to a step 52. In fact, the first microdrop 25*m* may be deformed and may rest on the first microdrop 20 trapped in the first trapping zone 15, therefore a stronger force is required for releasing it than for releasing the second microdrop 25*m* downstream. It is then possible to trap, in the second trapping zone 18*v* that is released, a second microdrop 25*v* different from the second microdrop 25*m* already trapped in step 48*b*.

Example of Chronology of Microdrop Trapping

In an embodiment example illustrated in FIG. 66, which shows the intensity of the trapping forces compared to the hydrodynamic drag on the ordinate, and time on the abscissa, the method comprises the following steps, for a capillary trap having two trapping zones:

- trapping a first microdrop in a first zone of the capillary trap, the trapping force F4 exerted by the first zone on the first microdrop being greater than the force Ft4 of hydrodynamic drag exerted by the flow on the first microdrop, in such a way that the latter remains trapped in the first zone, the drag force Ft4 being between F4 and F5, F5 denoting the trapping force exerted on the first microdrop by the second zone of the capillary trap,
- then, trapping a second microdrop in the second zone of the capillary trap, the force of hydrodynamic drag Ft5 exerted on the second microdrop by the flow during loading of the second microdrop in the second zone being between F5 and F3, with F3 preferably less than F4, F3 being the trapping force exerted by the second zone of the trap on the second microdrop. The drag force Ft5 is less than F4.

Selective Trapping of the Two Microdrops is Thus Obtained, in the Two Zones of the Capillary Trap Respectively.

Trapping According to the Size of the Microdrops

The second trapping zones 18 of the various capillary traps 12 in one and the same microfluidic system may have different properties, notably different sizes. This makes it possible, for example, to trap different second microdrops 25 in the different capillary traps 12 in order to obtain different microdrops. For example, for a given concentration of an element included in the second microdrops, the amount of its elements contained in a second microdrop depends on the size of said second microdrop. Thus, by producing second trapping zones 18 for example of different sizes in the same trapping chamber 30, it is possible to trap second microdrops 25 of different sizes selectively, with a size of second microdrop 25 corresponding to each size of second trapping zone 18.

Figure 55:
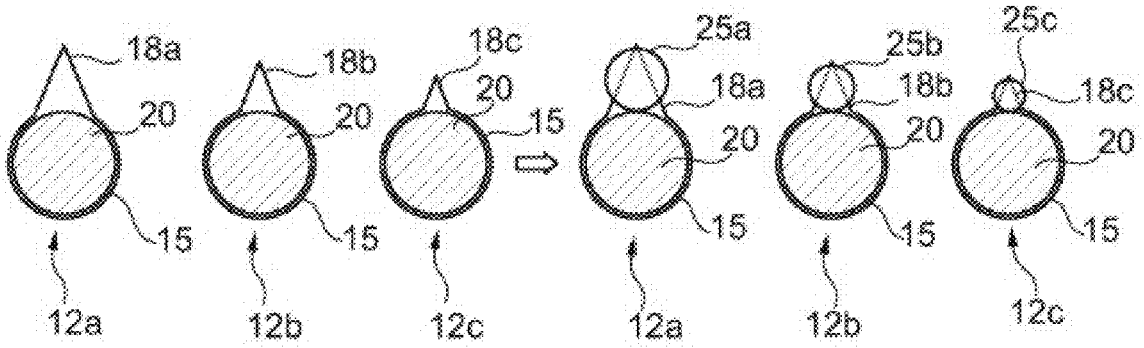

FIG. 55 illustrates three capillary traps 12*a*, 12*b* and 12*c* having second trapping zones 18*a*, 18 and 18*c* of different sizes. The first trapping zones 15 are filled with first microdrops 20. Second microdrops 25*a*, 25*b* and 25*c*, all of the same concentration but with different sizes, are supplied. The second trapping zones 18*a*, 18*b* and 18*c* each correspond to a size of second microdrop, the second microdrops 25*a*, 25*b* and 25*c* are then trapped in the second trapping zone 18*a*, 18*b* or 18*c* that corresponds to them best.

It is preferable to place the capillary traps 12*a*, 12*b* and 12*c* by trapping forces of the second trapping zones 18*a*, 18*b* and 18*c* relative to the largest of the second microdrops 18*a* increasing in the direction of the entraining force of the second microdrops, notably in the direction of the stream of fluid, in the microfluidic system. Thus, the second microdrops 25*a*, 25*b* and 25*c* first encounter the second trapping zones 18*c*, in which only the smallest second microdrops 25*c* are trapped, then the second trapping zones 18*b* in which only the second microdrops 25*b* are trapped and finally the second trapping zones 18*a* in which the largest second microdrops 25*a* are trapped.

As a variant, the microdrops 25*a*, 25*b* and 25*c* differ by another of their parameters, and they notably comprise different elements.

This makes it possible to obtain a panel of microdrops, at least some of which are different, notably in respect of their concentration of a compound and/or their composition.

Sequential Coalescence

Figure 56:
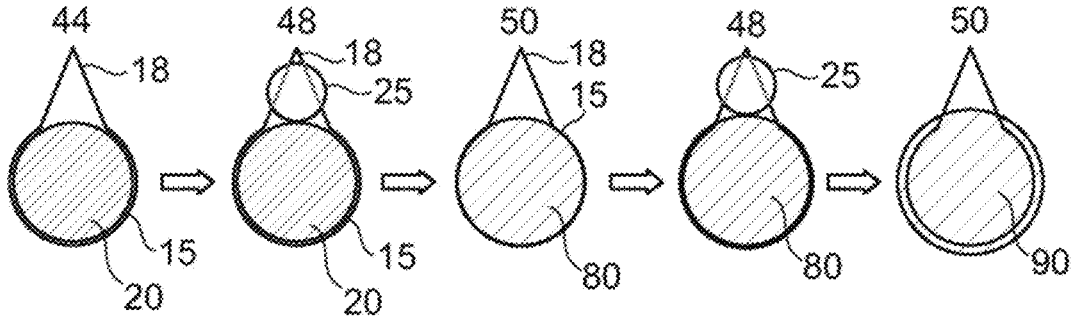

Steps 46, 48 and 50 may be repeated, as is illustrated in FIG. 56, to perform sequential coalescence. In each capillary trap 12, the microdrop obtained after step 50 becomes the new first microdrop 80 having as its volume the sum of the volumes of the first microdrop or microdrops 20 and of the second microdrop or microdrops 25 fused in the capillary trap 12. As the second trapping zone or zones 18 are free again, one or more third microdrops identical to or different from the initial second microdrop or microdrops 25 may be supplied to perform a new coalescence and obtain a new microdrop 90, which itself becomes the new first microdrop, and so on. With the successive coalescences, the microdrop will become larger owing to addition of the different volumes of the coalesced microdrops until it becomes so large that it prevents trapping of a new microdrop in the second trapping zone 18. The maximum coalescence number that may be performed in one and the same trap capillary 12 depends on the volume of the successive coalesced microdrops.

Note that if the coalescence step consists of removing the surfactant from the external phase or of destabilizing it chemically, a stabilization step may be necessary between the different coalescences. In practice, it is necessary to perfuse the trapping chamber with a fluid that is immiscible with the microdrops containing surfactant before bringing one or more new microdrops into the capillary trap.

The ability to perform sequential coalescence has several applications. If a first microdrop 20 trapped in a first trapping zone 15 of a capillary trap 12 contains cells (for example bacteria, yeasts or mammalian cells), sequential coalescence may allow the culture medium to be renewed several times by sequentially fusing second microdrops 25 containing a culture medium at predetermined times.

This may also serve for modeling the intermittent nature of administration of a medicinal product. For example, a first microdrop 20 containing a spheroid of mammalian cells and trapped in a capillary trap 12 is fused every 6 hours with a second microdrop 25 of medicinal product.

Drop Concentration Gradient

The capillary traps 12 in the trapping chamber 30 may be different and their locations may be controlled. It is possible for example to have capillary traps 12 having a different number of second trapping zones.

Figure 57:
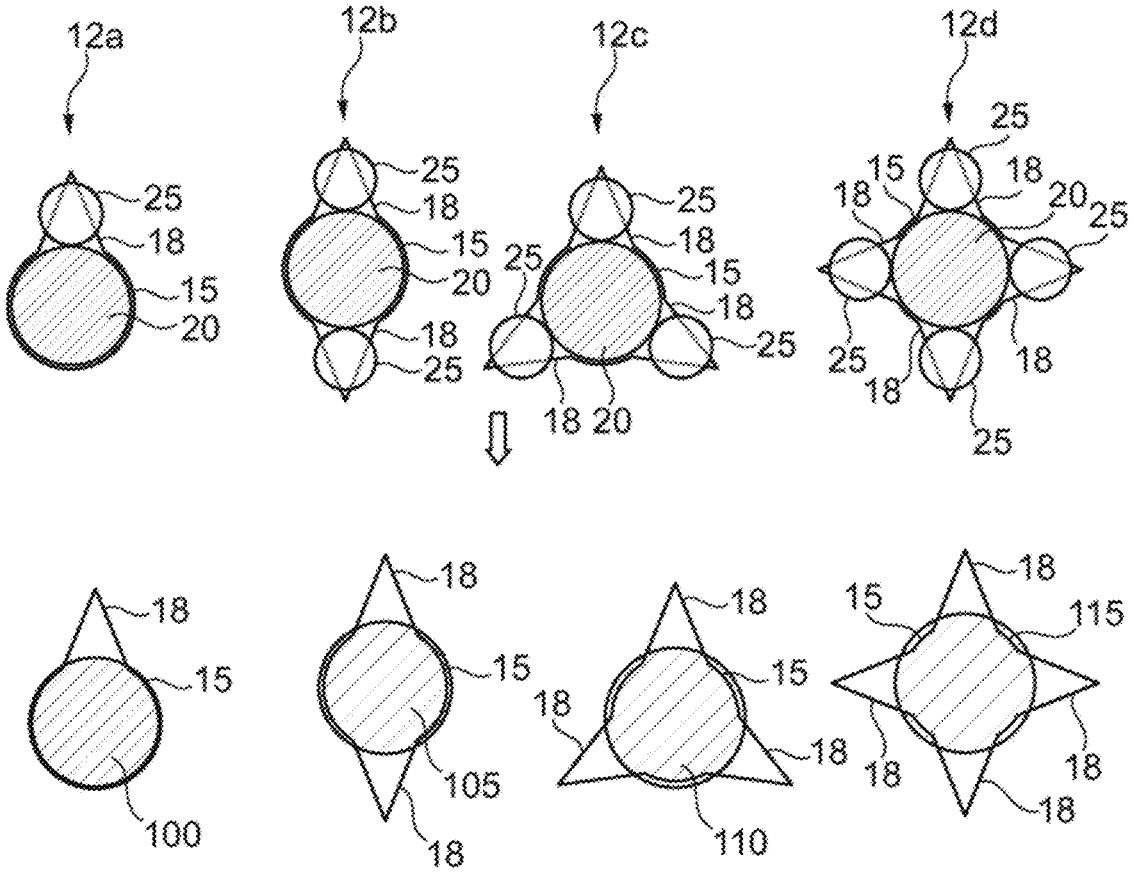

As is illustrated in FIG. 57, the trapping chamber 30 may comprise capillary traps 12*a*, 12*b*, 12*c* and 12*d* respectively having one, two, three and four identical second trapping zones 18 uniformly distributed around a first trapping zone 15. If the first microdrops 20 are identical and comprise a compound of interest, it is possible to obtain microdrops 100, 105, 110 and 115 in the microfluidic chamber, forming a spatial gradient of four concentrations of a compound of interest, represented here by different gray levels, after coalescence with the second trapped microdrops 25, which may for example contain a diluent.

Panels of Microdrops

Injection of panels of microdrops comprising different compounds and/or different concentrations in a chamber containing capillary traps 12 as described above offers many applications.

Take the example of a trapping chamber of 2 $cm^2$ having 1000 capillary traps each making it possible to trap a first and a second microdrop 20 and 25. The first microdrops 20 form a panel of microdrops containing a first compound in 20 different concentrations. The second microdrops 25 contain a second compound in 10 different concentrations. By fusing the first and the second microdrops 20 and 25 in the capillary traps 12, it is possible to obtain a matrix of microdrops each corresponding statistically to one combination among the 200 possible combinations of first and second microdrops 20 and 25.

The fact that the microdrops are static also makes it easier to obtain kinetic data. There is also the advantage of economy of reagents, through the use of very small volumes in the microdrops.

The trapping chamber 30 may have a surface area greater than 2 $cm^2$, giving a further large increase in the number of different reactions that may be carried out in parallel in a microfluidic system.

The compounds contained in the first and second microdrops 20 and 25 may be chemical molecules that will react with one another and whose initial concentrations are required to be optimized. The method described above makes it possible to carry out large-scale combinatorial chemistry. The microdrops may then comprise one or more identifying means. This may make it possible for example to measure the concentration of the end product, for example by fluorescence or spectroscopy.

As a variant, the first and/or second microdrops 20 and/or 25 may contain proteins, enzymes, and cells at various concentrations.

The microfluidic system and the method described above may make it possible to investigate protein crystallization. In fact, obtaining a crystal from a purified solution of protein is an essential step for determining its three-dimensional structure since this makes it possible to obtain an X-ray diffraction pattern. However, the protein is always available in very small amounts and the optimum crystallization conditions vary from one protein to another.

For example, using a trapping chamber 30 with several capillary traps 12, each making it possible to trap a first and a second microdrop 20 and 25, gives a first microdrop panel comprising a saline solution in different concentrations and a second microdrop panel comprising a protein of interest in different concentrations. By fusing the first and the second microdrops 20 and 25 in the capillary traps 12, it is possible to obtain a matrix of microdrops representing conditions of different concentrations of saline solution and proteins, so as to be able to determine the concentrations allowing optimum protein crystallization.

By immobilizing, on the capillary traps 12, first microdrops 20 comprising an element of interest in identical concentration in the whole trapping chamber and by fusing the latter with second microdrops 25 obtained from a panel of microdrops comprising a titrating species in different concentrations, it is possible to perform titration of the species of interest contained in the first microdrops 20. This application may be particularly advantageous in the case of reagents that are expensive or available in small amounts.

The method presented here may also be very useful for screening medicinal products. For example, cancer cells may be cultured, in individualized form or in the form of spheroids, in first microdrops 20 trapped in each of the first trapping zone 15 of the capillary trap 12, and after culture for some days, it is possible to coalesce them in each trap with a second microdrop 25 containing a medicinal product to be screened, the second microdrops 25 being obtained from a panel of microdrops containing different medicinal products.

In a similar configuration, we may imagine the culture of liver cells in the form of spheroids in first trapped microdrops 20 and the supply, to each of the capillary traps 12, of a second microdrop 25 containing a medicinal product, whose toxicity we wish to evaluate, each microdrop being obtained from a panel of microdrops comprising the medicinal product in different concentrations. By analyzing the results for viability some days after coalescence, it is possible for example to deduce the concentration of this medicinal product that kills half of the cellular population.

This method may also allow evaluation of the interactions between different antibiotics. It is possible to create a panel of second microdrops 25 containing one or more antibiotics in different concentrations and fuse them in the trapping chamber 30 with first microdrops 20 containing bacteria. The first microdrops 20 may comprise a bacterium in different concentrations. This makes it possible to explore a space with 3 parameters.

The application of microfluidics may be very advantageous in the context of rare samples such as biopsies. The microfluidic system may for example be used in the context of personalized medicine and cancer treatment. With this system it is possible to culture, for example in the form of spheroids in first trapped microdrops 20, tumor cells from a patient who has undergone a biopsy and subject them to different medicinal products at multiple concentrations by feeding the second microdrops 25 into the trapping chamber 30. After coalescence of the pairs of microdrops with cells and the medicinal product, the most effective medicinal product and its concentration for a particular patient may be determined using only a single trapping chamber 30 and a minimal number of cells obtained from the biopsy.

Tissue Engineering

The method as described above may make it possible to fuse microdrops containing cells, which may or may not be of different cell types, for accurately forming microtissues.

The capillary trap may be as illustrated in FIGS. 5A and 5B. Preferably, the first trapping zone 15 has a height such that its volume is greater than that of the first microdrop, so that the first trapped microdrop 20 has a bottom that is not flat, and notably is convex, as illustrated in FIG. 5A. Thus, the cells contained in said first microdrop 20 slide along the interface of the latter during sedimentation and aggregate at the bottom of the first trapped microdrop 20 and form a spheroid, as described in international application WO 2016/059302, incorporated here by reference.

A first microdrop 20 may contain cells of a first cell type in a liquid medium and may be trapped in the first trapping zone 15 of said capillary trap 12 to form, after immobilization for one day, a first spheroid spontaneously by sedimentation of the cells. Preferably, the microfluidic system does not have a stream of fluid near the capillary trap during formation of the first spheroid so that the liquid of the first microdrop 20 is not caused to move. A second microdrop 25 containing cells of a second cell type in a liquid medium may be trapped in the second trapping zone 18. After coalescence of the first and of the second microdrop, a culture of cells of two different types is obtained, the architecture of which depends in particular on the experimental conditions.

If the first microdrop 20 is liquid, the cells of the second microdrop 25 mix, after coalescence, with the contents of the first microdrop 20 and then settle, giving the spheroid of cells of the first cell type directly.

If the cells of the second microdrop 25 have had time before coalescence to form a second spheroid, coalescence of the two microdrops 20 and 25 leads to fusion of the first and second spheroids.

If coalescence takes place before the cells of the second microdrop 25 have had time to form a spheroid, the cells will be deposited after sedimentation on the surface of the first spheroid.

If now one of the two microdrops 20 or 25 is gelled before the coalescence operation, the two cellular populations are compartmentalized. In fact, if the first microdrop 20, which contains the first spheroid, is gelled before the second microdrop 25 arrives, the cells of second cell types will no longer be able, after coalescence of the microdrops 20 and 25, to come directly into contact with the first spheroid owing to the presence of the gel. For example, mammalian cells cannot pass through a matrix of agarose at 0.9 wt %. The two groups of cells can then only communicate with one another by the paracrine route.

The example given here is for a capillary trap 12 trapping a first and a microdrop 20 and 25 but it is possible to obtain more complex architectures of microtissues with a capillary trap 12 allowing more than two microdrops to be trapped and/or methods as described above consisting of coalescing several microdrops sequentially by varying or not varying the orientation of the stream of fluid. It is also possible to use a plurality of capillary traps as described above to form a plurality of microtissues in parallel.

This technique for forming microtissues may make it possible to create microtissues in vitro with a controlled architecture for very faithfully mimicking the conditions encountered in vivo. In fact, in the body the different cell types are often arranged in tissues according to a specific architecture that is important for recreating a function at the level of an organ.

The latter may also be used for the purpose of transplantation in a patient. For example, glucagon-producing alpha cells and insulin-producing beta cells may be combined to create islets of Langerhans intended to be transplanted into a patient's pancreas to treat diabetes. Similarly, hepatocytes and stellate cells could be combined in the context of liver transplant.

Hydrogels

The method as described above may also be used for creating multilayer gel microdrops.

The capillary trap 12 may be as described above and may comprise a first trapping zone 15 and a second trapping zone 18.

As is illustrated in FIG. 58, a first microdrop 20 containing a first gellable medium may be trapped in the first trapping zone 15, and then the first gellable medium may be gelled to form a microdrop 200 of a first gel, as illustrated in step 54. The first gelled microdrop 200 may then fuse, according to step 58, with a second microdrop 25 containing a second gellable medium and trapped in step 56 in the second trapping zone 18. After this coalescence, the second gellable medium may be gelled to constitute an outer layer 202 of a second gel on the first gel. This operation may be repeated several times sequentially to form a microdrop having a core of the first gel and a plurality of successive outer layers of the other gels.

As a variant illustrated in FIG. 59, the second gellable medium contained in the second microdrop 25 is gelled to form a microdrop 204 of a second gel before fusing with the first microdrop. When the two microdrops are fused, they retain their shape and position before fusion and form a gelled microdrop 210 of a shape that depends on the shape, arrangement and number of trapping zones.

The method may also make it possible to obtain spheroids encapsulated in biological hydrogels.

In order to be able to form spheroids in microdrops in a controlled manner it is necessary to be able to keep the contents of the microdrop liquid during the time of formation of the spheroid. Agarose is very suitable for this protocol as it is a heat-sensitive hydrogel. It remains liquid at 37° C. (ultra low gelling agarose) and then solidifies after 30 min at 4° C. and remains solidified after returning to 37° C. However, mammalian cells cannot adhere to agarose and they cannot digest it either. This matrix is therefore very different from the extracellular matrix encountered in the body. The use of hydrogels such as for example type I collagen, fibronectin, Matrigel® or gelatin could be preferable for better simulation of natural conditions. However, it is more difficult to control their gelation. For example, type I collagen cannot be kept liquid for a long time with favorable conditions for cell culture (low temperature or acid pH). If cells are encapsulated in a collagen microdrop that is gelled quickly after trapping, rather than adhering to one another and forming a spheroid, the cells will adhere to the collagen and migrate individually along its fibers.

This problem can be solved by the method according to the invention.

The capillary trap may be as illustrated in FIGS. 5A and 5B. Preferably, the first trapping zone 15 has a height such that the first trapped microdrop 20 has a bottom that is not flat, notably convex, as is illustrated in FIG. 5A, so that the cells contained in said first microdrop 20 slide along the interface of the latter during sedimentation, and aggregate at the bottom of the first trapped microdrop 20 and form a spheroid, as described in international application WO 2016/059302, incorporated here by reference.

A first microdrop 20 may contain cells of a first cell type in a liquid medium and may be trapped in the first trapping zone 15 of said capillary trap 12 to form, after immobilization for one day, a spheroid spontaneously by sedimentation of the cells. Preferably, the microfluidic system does not have a stream of fluid near the capillary trap during formation of the spheroid, so that the liquid of the first microdrop 20 is not caused to move. A second microdrop 25 containing one of the biological hydrogels mentioned above in high concentration may be trapped in the second trapping zone 18. Once this second microdrop is trapped, the two microdrops are fused immediately in such a way that the biological hydrogel, still liquid, mixes with the first microdrop that contains the spheroid. Gelation then takes place and the spheroid is encapsulated in an extracellular matrix representative of the biological conditions encountered in vivo.

This technique of spheroid encapsulation may be combined with the technique for forming microtissues described above to allow more complex architectures of microtissues to be obtained.

The following nonlimiting examples describe embodiment examples of the invention as described above.

EXAMPLE 1

An experiment was carried out to demonstrate the feasibility of the method. The trapping chamber 30 used is of 2 $cm^2$ and contains 393 identical capillary traps similar to that in FIGS. 1A, 1B and 2 and having the following dimensions:

a=250 μm, b=c=150 μm,

H=100 μm, and h=50 μm.

The capillary traps 12 are distributed according to a matrix as illustrated in FIG. 49.

The microdrops comprise food dyes. Drops of 1 μL with five different colors ranging from blue to green to yellow were formed by the "micro-segmented flows" technique. These 1 μL drops were fractionated into many first monodisperse nanoliter microdrops 20 using a slope (method described at point f) above). These first microdrops 20 of various colors were then mixed to form a first panel of microdrops comprising different colors and were then injected into the trapping chamber 30 containing the capillary traps 12. The size of the first microdrops 20 was adjusted so that they fully occupy the first trapping zones 15. The second trapping zones 18 remain empty.

In the same way, five hues of 1 μL drops ranging from transparent, colorless to red were formed and then fractionated into second microdrops smaller than the first microdrops owing to a differently designed slope. These second microdrops were mixed to form a second panel of microdrops comprising different colors and were then injected into the microfluidic chamber, where they are trapped in the second free trapping zones 25.

A matrix of pairs of first and second microdrops 20 and 25 as illustrated in FIG. 60*a*) is then obtained. Therefore 25 different pairs are possible. The first and second microdrops 20 and 25 in contact are fused by perfusing the trapping chamber 30 with HFE-7500 containing 1H,1H,2H,2H-perfluorooctan-1-ol at a concentration of 20 vol %. The colors of the two microdrops in contact in each of the capillary traps mix and take on one of the 25 possible colors depending on the color of the initial microdrops, as can be seen in FIG. 60*b*). A matrix of microdrops of 25 different colors is then obtained.

This experiment demonstrates that it is possible to combine different reagents in different concentrations within one and the same trap, in parallel in a trapping chamber 30, after coalescence of pairs of different compositions.

EXAMPLE 2

An experiment was carried out for obtaining spheroids resulting from two successive fusions of separate spheroids.

The microfluidic system comprises a trapping chamber 30 having a matrix of capillary traps as illustrated in FIGS. 5A and 5B having the following dimensions:

H=165 μm, and $h_1$=388 μm, $h_2$=80 μm, c=200 μm, a=400 μm.

Rat hepatic cells (H4IIEC3) were first encapsulated in first microdrops 20. The first microdrops 20 were trapped in the first trapping zones 15 and, after sedimentation, the cells collect at the bottom of each drop to form a first spheroid 130. After one day, necessary for formation of these first spheroids, second microdrops 25 were trapped in the second trapping zones 18, as can be seen in FIG. 61A. The latter also contain H4IIEC3 cells but, in contrast to the first, they were colored red with a fluorescent marker (CellTracker Red®). These pairs of first and second microdrops 20 and 25 were kept as they were for one day so that the red cells of the second microdrops 25 collect and form a second spheroid 135 at the bottom of each second microdrop 25. The first and second microdrops in contact were then fused by perfusing the chamber with HFE-7500 (fluorinated oil) containing 1H,1H,2H,2H-perfluorooctan-1-ol at a concentration of 20 vol %.

After coalescence in each trap, the second spheroid 135 sediments and comes into contact at the bottom of the first microdrop with the first spheroid 130 in a new first microdrop 140, as can be seen in FIG. 61B. These two spheroids in contact will adhere to one another and fuse to form only a single new spheroid with two parts 130 and 135 clearly identifiable by fluorescence imaging (the cells derived from the second spheroid will continue to appear red in the fused spheroid). The chamber is then perfused with oil containing surfactant to restore stability of the new first microdrops for the rest of the experiment.

This operation was then repeated, this time with third microdrops 85 encapsulating H4IIEC3 cells that had been colored green (CellTracker Green®), as can be seen in FIG. 61C. Similarly, the third green spheroids 145 were formed in the third microdrops 85, as illustrated in FIG. 61D, and then the third microdrops 25 were fused with the new first microdrops, as illustrated in FIG. 61E. The third green spheroids 145 and the new spheroid 140 in contact will adhere to one another and fuse to form only a single spheroid with three parts clearly identifiable by fluorescence imaging.

Therefore we finally obtain a matrix of three-colored spheroids, as illustrated in FIG. 62, in each of which the three spheroids of different colors are identifiable.

This experiment demonstrates the potential of the technique for applications connected with tissue engineering. In fact, rather than fusing spheroids of one and the same cell type but with different colors, we may easily imagine fusing spheroids of complementary cell types to create functional microtissues with a well-defined architecture.

EXAMPLE 3

An experiment was conducted to determine, in a single microfluidic system, the concentration beyond which a medicinal product (acetaminophen) becomes toxic to liver cells (rat hepatoma, H4IIEC3 cells).

The microfluidic chamber used containing 252 identical traps on 2 $cm^2$ in FIGS. 5A and 5B.

The first microdrops 20 of agarose that is liquid at 37° C. (ultra-low gelling), at 0.9 wt % diluted in culture medium containing H4IIEC3 cells, were trapped in the first trapping zones 15, the second trapping zone 18 remaining free. The first microdrops 20 were then cultured for one day to allow the cells to adhere to one another to form a spheroid by first microdrops 20. The first microdrops 20 were then gelled by application of a temperature of 4° C. for 30 min.

In parallel, acetaminophen was dissolved at high concentration in culture medium. Fluorescein at high concentration was added to this solution. The solution obtained was diluted to different concentrations with pure culture medium to form 14, drops at different concentrations. These drops were then fractionated into second microdrops 25 by means of a slope and then mixed before being injected into the trapping chamber 30 containing the first microdrops 20. These second microdrops 25 were smaller than the first microdrops 20 and were trapped in the second trapping zones 18.

By taking a fluorescence image before fusion, the different levels of fluorescence that are correlated with the concentration of medicinal product in the second microdrops 25 could be identified. Even if these drops were immobilized randomly in traps, it is then possible to find the concentration of acetaminophen with which it was combined in the capillary trap 12, corresponding to each spheroid.

The chamber was perfused with HFE-7500 (fluorinated oil) containing 1H,1H,2H,2H-perfluorooctan-1-ol at a concentration of 20 vol % in order to fuse the microdrops in contact. The acetaminophen then diffused through the gelled agarose and acted on the cells. After one day of exposure to acetaminophen, the oil that separates the microdrops from one another is replaced with an aqueous phase as described in international application WO 2016/059302 to color the spheroids with fluorescent viability markers present in the aqueous phase. By taking an image of the final matrix, the spheroids whose viability was affected most could be determined. It was found that the higher the concentration of acetaminophen, the fewer cells survive. Thus, correlating the result for viability and the concentration of acetaminophen in the second microdrops, it could be determined that the range of toxicity of acetaminophen on these hepatic cells is between 10 and 30 mmol/L for a static exposure of 1 day.

The work that led to this invention received financing from the European Research Council in the context of the Seventh Framework Programme of the Union (FP7/2007-2013)/ERC grant agreement No. 278248.

The invention claimed is:

1. A method for manipulating at least one first liquid microdrop and at least one second liquid microdrop in a microfluidic system comprising a capillary trap having a first trapping zone and a second trapping zone, said method comprising the steps consisting of:

(i) trapping the first microdrop in the first trapping zone, and (ii) trapping the second microdrop in the second trapping zone, the first and the second trapping zones being arranged in such a way that the first and the second microdrops are in contact with one another, the first and the second trapping zone being configured in such a way that the trapping forces that would be exerted by the first and by the second trapping zone on a same first or second liquid microdrop would be different, the first microdrop being trapped in the first trapping zone with a trapping force that is greater than the trapping force the second trapping zone would exert on the first microdrop, the microdrops being moved at step (i) in the microfluidic system by an entraining force greater than the trapping force the second trapping zone would exert on the first microdrop and less than or equal to the trapping force of the first trapping zone on the first microdrop.

2. The method as claimed in claim 1, the at least one second liquid microdrop being of smaller size or of smaller volume than the first microdrop.

3. The method as claimed in claim 1, the first and the second microdrop being different or with different contents.

4. The method as claimed in claim 1, the capillary trap comprising a plurality of second trapping zones, step (ii) consisting of trapping one second microdrop per second trapping zone, the first and the second trapping zones being arranged in such a way that each second microdrop is in contact with at least one of the first or second microdrops.

5. The method as claimed in claim 4, step (ii) comprising the substeps (ii') consisting of trapping, under the effect of a first oriented stream of fluid, a second microdrop in one or some of the second trapping zones and (ii") consisting of trapping, under the effect of a second oriented stream of fluid, a second microdrop in another or some other part of the second trapping zones, the first and the second stream of fluid being of different orientation.

6. The method as claimed in claim 1, comprising step (iii) consisting of fusing, with the first microdrop, the or each of the second microdrops trapped in the or each of the second trapping zones.

7. The method as claimed in claim 6, comprising, after step (iii), a step consisting of trapping a third microdrop in the second trapping zone or zones that no longer have a second microdrop, so that the first and the third microdrop are in contact with one another.

8. The method as claimed in claim 1, the microdrops being fed randomly into the trapping zones.

9. The method as claimed in claim 1, the height of the first trapping zone being such that the volume of the first trapping zone is greater than or equal to the volume of the first microdrop.

10. The method as claimed in claim 1, comprising:

trapping the first microdrop in the first trapping zone of the capillary trap, the trapping force F4 exerted by the first zone on the first microdrop being greater than the force Ft4 of hydrodynamic drag exerted by the stream oriented on the first microdrop, in such a way that the latter remains trapped in the first zone, the drag force Ft4 being between F4 and F5, F5 denoting the trapping force exerted on the first microdrop by the second trapping zone of the capillary trap, then, trapping the second microdrop in the second trapping zone of the capillary trap, the force of hydrodynamic drag Ft5 exerted on the second microdrop by the stream oriented during loading of the second microdrop in the second zone being between F5 and F3, F3 being the trapping force exerted by the second zone of the capillary trap on the second microdrop.

11. The method as claimed in claim 10, the trapping force F3 exerted by the second zone of the capillary trap on the second microdrop being less than trapping force F4 exerted by the first zone on the first microdrop.

12. A microfluidic device for trapping microdrops comprising a capillary trap having a first trapping zone and a second trapping zone arranged in such a way that a first liquid microdrop trapped in the first trapping zone and a second liquid microdrop trapped in the second trapping zone are in contact with one another in the capillary trap, the first and the second trapping zone being configured in such a way that the trapping forces that would be exerted by the first and by the second trapping zone on a same first or second liquid microdrop would be different, the device being configured to exert on the first microdrop an entraining force greater than the trapping force the second trapping zone would exert on the first microdrop and less than or equal to the trapping force of the first trapping zone on the first microdrop.

13. The device as claimed in claim 12, the first and the second trapping zone being cavities.

14. The device as claimed in claim 12, the first and the second trapping zone differing by at least one of their dimensions.

15. The device as claimed in claim 12, the first and the second trapping zone being of different heights.

16. The device as claimed in claim 12, the first and the second trapping zone being of different shapes, when viewed from above.

17. The device as claimed in claim 16, the first trapping zone having a larger section than the second trapping zone.

18. The device as claimed in claim 12, the second trapping zone becoming wider in at least one direction on approaching the first trapping zone.

19. The device as claimed in claim 12, the capillary trap comprising a plurality of second trapping zones arranged in such a way that each second trapped microdrop is in contact with at least one of the first or second trapped in the capillary trap.

20. The device as claimed in claim 12, comprising a plurality of capillary traps each comprising a first trapping zone and a second trapping zone.

21. The device as claimed in claim 20, the first trapping zone and the second trapping zone being arranged in such a way that the second microdrop trapped in the second trapping zone of the capillary trap is in contact with the first microdrop trapped in the first trapping zone of said capillary trap.

22. The device as claimed in claim 20, comprising at least 10 capillary traps per square centimeter.

23. The device as claimed in claim 20, comprising a first capillary trap comprising n second trapping zones and a second capillary trap comprising p second trapping zones, n being different from p.

24. The device as claimed in claim 12, comprising a channel having a trapping chamber, the capillary trap or traps being in the trapping chamber.

25. The method as claimed in claim 1, wherein the microfluidic system comprises a plurality of capillary traps, each capillary trap having a first trapping zone for trapping each a first microdrop and a second trapping zone for trapping each a second microdrop, the first microdrops forming a first panel of microdrops that are identical or of which at least y are different and the second microdrops forming a second panel of microdrops of which at least z are different, the method comprising fusing each first microdrop with the second microdrop in contact therewith so as to obtain a panel of microdrops in the microfluidic system each corresponding to one combination among the different possible combinations of first and second microdrops.

26. The method as claimed in claim 25, wherein the second panel of microdrops comprises second microdrops that are different at least in their contents.

27. The method as claimed in claim 25, wherein the second panel of microdrops comprises second microdrops that are different in their concentration of a second compound of interest.

28. The method as claimed in claim 25, comprising an additional step (iv) of observation or of measurement before a step (iii) consisting of fusing, with the first microdrop, the or each of the second microdrops trapped in the or each of the second trapping zones.

29. The method as claimed in claim 25, comprising an additional step (iv) of observation or of measurement after a step (iii) consisting of fusing, with the first microdrop, the or each of the second microdrops trapped in the or each of the second trapping zones.

30. The method as claimed in claim 25, wherein the first microdrops each comprises cells and the second microdrops each comprises a medicinal product to be screened at a defined concentration.

31. The method as claimed in claim 25, wherein the first microdrops each comprises cancerous cells and the second microdrops comprising different medicinal product to be screened.

32. The method as claimed in claim 25, wherein the first microdrops each comprises liver cells cultured in the form of spheroids and a second microdrop containing a medicinal product at different concentrations, whose toxicity we wish to evaluate, is supplied in each of the second trapping zones.

33. The method according to claim 32, wherein the first microdrops are agarose microdrops comprising liver cells cultured in the form of spheroids, the method comprising forming spheroids of liver cells and gelling the agarose.

34. The method as claimed in claim 32, comprising determining the viability of cells in each microdrops few days after the fusing step of the first and second microdrops to determine the concentration of the medicinal product that kills at least half of the cells.

35. The method as claimed in claim 25, wherein the first microdrops each comprises tumoral cells obtained from a biopsy.

36. The method as claimed in claim 25, wherein the first microdrops each comprises tumoral cells obtained from a biopsy of a particular patient cultured in the form of spheroids, the second microdrops comprise various active substances at multiple concentrations and the method comprises the determination of the active substance among the various active substance and the concentration of the latter that is the most effective, for the particular patient.

37. The method as claimed in claim 1, wherein one of the first microdrop and second microdrop comprises a gellable medium and the other comprises a plurality of cells, said method additionally comprising the steps consisting of:

(iii) fusing the first microdrop with the second microdrop, (iv) gelling the gellable medium to encapsulate the plurality of cells in the gel.

38. The method as claimed in claim 37, comprising the formation of spheroids of cells before gelling step (iv).

* * * * *